US011247473B2

(12) United States Patent
Bonneton et al.

(10) Patent No.: US 11,247,473 B2
(45) Date of Patent: Feb. 15, 2022

(54) METHOD AND DEVICE FOR MAINTAINING A NOZZLE PRINT HEAD

(71) Applicant: Dover Europe Sàrl, Vernier (CH)

(72) Inventors: Damien Bonneton, Hostun (FR); Camille Gobin, Lyons (FR); Jean-François Abadie, Bourg de Péage (FR); Jean-Marie Rolland, Romans sur Isere (FR); Niklaus Hugi, Bern (CH)

(73) Assignee: DOVER EUROPE SÀRL, Vernier (CH)

( * ) Notice: Subject to any disclaimer, the term of this patent is extended or adjusted under 35 U.S.C. 154(b) by 0 days.

(21) Appl. No.: 16/447,165

(22) Filed: Jun. 20, 2019

(65) Prior Publication Data

US 2019/0389222 A1 Dec. 26, 2019

(30) Foreign Application Priority Data

Jun. 21, 2018 (FR) ..... 1855502

(51) Int. Cl.
*B41J 2/165* (2006.01)
*B41J 2/02* (2006.01)

(52) U.S. Cl.
CPC ..... *B41J 2/16552* (2013.01); *B41J 2/02* (2013.01)

(58) Field of Classification Search
CPC ..... B41J 2/02; B41J 2/035; B41J 2/075; B41J 2/085; B41J 2/09; B41J 2/115; B41J 2/12;

(Continued)

(56) References Cited

U.S. PATENT DOCUMENTS 4,623,897 A * 11/1986 Brown ..... B41J 2/1707 347/21
6,575,556 B1 * 6/2003 Eremity ..... B41J 2/16552 347/28

(Continued)

FOREIGN PATENT DOCUMENTS

EP 1318916 A1 * 6/2003
EP 1318916 B1 9/2005

(Continued)

OTHER PUBLICATIONS

Preliminary French Search Report for Application No. 1855502, dated Feb. 12, 2019.

*Primary Examiner* — Scott A Richmond
(74) *Attorney, Agent, or Firm* — Pearne & Gordon LLP

(57) ABSTRACT

A print head of a continuous ink jet printer comprising: a cavity for the circulation of jets, delimited laterally by a 1st side wall and a 2nd side wall, both at least partially parallel to a direction of flow of the jets in the cavity, at least one nozzle for producing at least one ink jet in the cavity, at least one electrode for sorting drops or segments of one or several of the jets intended for printing from drops or segments that are not used for printing; an outlet slot, open onto the exterior of the cavity and allowing the exiting of the drops or segment of ink intended for printing, at least one gutter for recovering drops or segments not intended for printing, at least one spraying nozzle, arranged in the cavity, for projecting at least one cleaning fluid towards at least one inner portion of the cavity and a motor driving the at least one spraying nozzle in rotation about an axis (x), for example perpendicular to a direction of flow of the jets in the cavity; a supply circuit supplying at least the spraying nozzle with cleaning fluid.

14 Claims, 9 Drawing Sheets

(58) Field of Classification Search
CPC ..... B41J 2/125; B41J 2002/022; B41J 2002/1853
See application file for complete search history.

(56) References Cited

U.S. PATENT DOCUMENTS

| | | | | |
|---|---|---|---|---|
| 7,192,121 | B2 | 3/2007 | Barbet et al. | |
| 8,162,450 | B2 | 4/2012 | Barbet | |
| 2010/0045753 | A1 | 2/2010 | Barbet | |
| 2010/0110151 | A1 | 5/2010 | Griffin et al. | |
| 2010/0271441 | A1* | 10/2010 | Martin | B41J 2/03 347/74 |
| 2011/0285786 | A1 | 11/2011 | Sekiya | |
| 2018/0032718 | A1 | 2/2018 | Soto et al. | |
| 2018/0319170 | A1 | 11/2018 | Bonneton | |
| 2018/0361753 | A1 | 12/2018 | Odin et al. | |
| 2019/0030897 | A1* | 1/2019 | Piatt | B41J 2/16552 |

FOREIGN PATENT DOCUMENTS

| | | | | |
|---|---|---|---|---|
| EP | 1725408 | B1 | 10/2008 | |
| FR | 2906755 | B1 | 1/2009 | |
| GB | 2316364 | A * | 2/1998 | B41J 2/1714 |
| GB | 2316364 | A | 2/1998 | |
| WO | 2011/012641 | A1 | 2/2011 | |

* cited by examiner

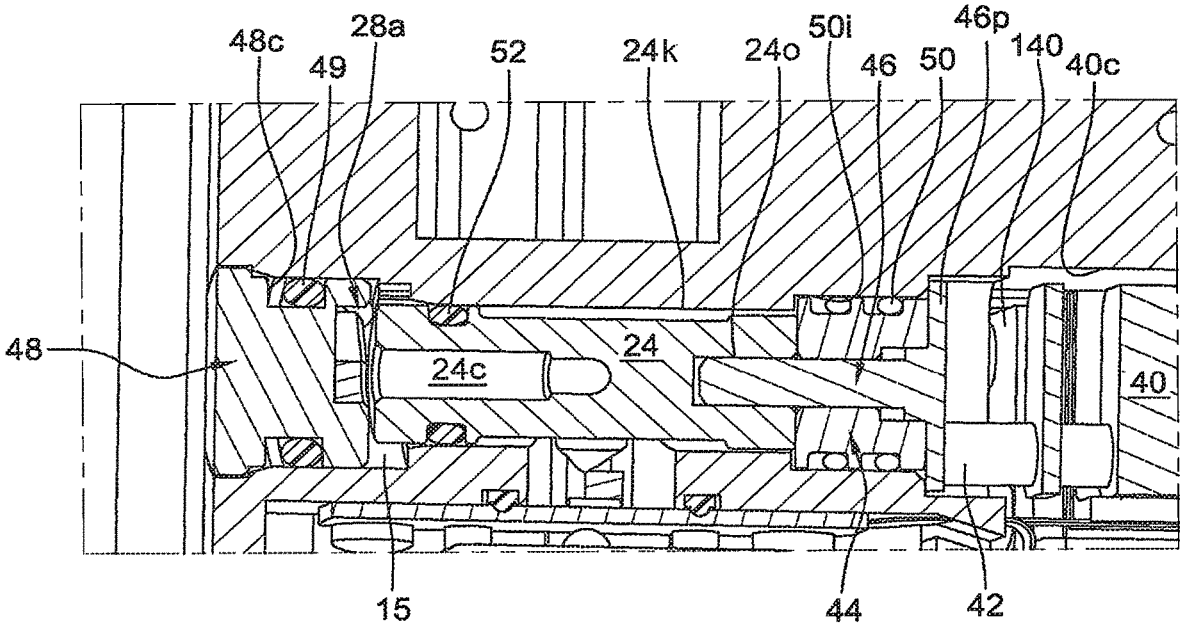
FIG.7A
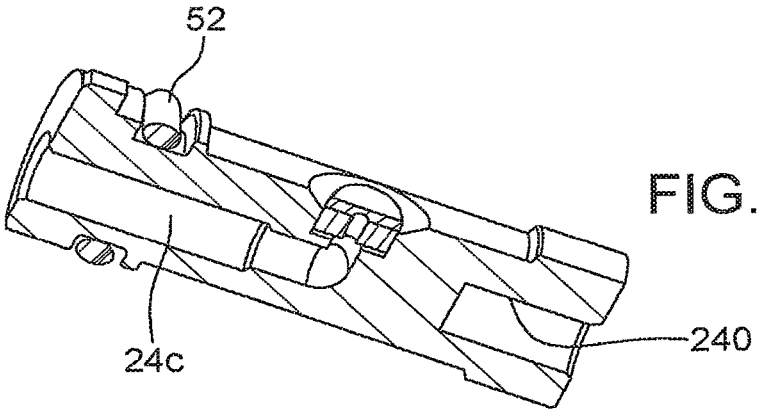
FIG.7B
FIG.7C
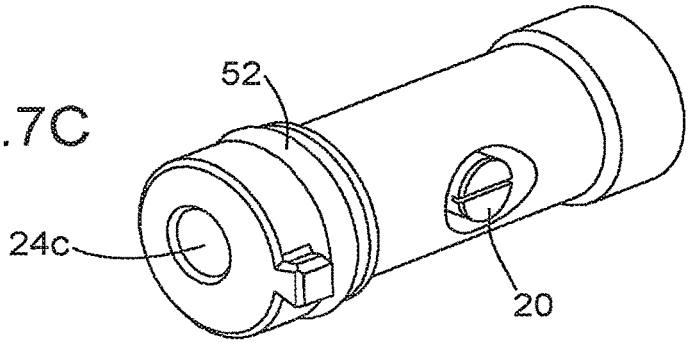

METHOD AND DEVICE FOR MAINTAINING A NOZZLE PRINT HEAD

CROSS-REFERENCE TO RELATED APPLICATIONS

This application claims priority from French Patent Application No. 1855502, filed Jun. 21, 2018. The content of this application is incorporated herein by reference in its entirety.

TECHNICAL FIELD AND PRIOR ART

The invention relates to the print heads of printers or continuous ink jet printers, in particular, binary continuous ink jet printers provided with a multi-nozzle drop generator or with a multi-jet generator.

Continuous ink jet printers comprise a print head, which comprises a generator of drops of ink associated with a cavity for forming jets which contains means, most often one or several electrodes, in order to separate the trajectories of drops produced by the generator and direct them to a printing support or towards a gutter for recovering.

A $1^{st}$ problem linked to this type of print head is the deposition of dirt (or projections of ink) inside the cavity, in particular on the electrode or electrodes or on the walls or in the gutter for recovering drops not used for printing.

A solution to this problem of dirt consists in carrying out a manual cleaning of the cavity, which requires disassembling it beforehand. This means removing the head from its location in the product chain in order to bring it to a maintenance station, so as to recover the cleaning solvent without dirtying the conveyor or the products of the user (that the latter was in the process of marking or was going to mark before the interruption). Another solution is to bring a maintenance station around the head, as long as there is room. The head is then simply displaced, it is not disassembled from the production chain. However, the cover of the print head has to be removed or opened.

It is desirable to avoid manual intervention from the operator on the one hand because, in particular, such an intervention is a loss of time and that dirt is possible during this operation, but also, on the other hand, because the impact of this intervention on the effectiveness of the print head is not controlled (there can in particular be a disturbance effect on later operation).

Another problem is that of the forming of a jet, for example a jet of solvent, for the cleaning of the ink circuit; this jet is projected, by the nozzles that are usually used to form the ink jets, outside of the cavity which can be dirty and expensive (the liquid projected is indeed then not recoverable).

The same problems arise for a print head of the CIJ type.

DISCLOSURE OF THE INVENTION

The invention first has for object a print head of a continuous ink jet printer comprising:

- a cavity for the circulation of jets,
- means for producing at least one ink jet in said cavity, a $1^{st}$ side wall and a $2^{nd}$ side wall, both at least partially parallel to a direction of flow of the jets in the cavity,
- means, for example arranged in or on the $1^{st}$ side wall, in order to sort or separate drops or segments of one or several of said jets intended for printing drops or segments that are not used for printing;

- a slot open onto the exterior of the cavity and allowing for the exiting of the drops or segment of ink intended for printing,
- a gutter, or a $1^{st}$ gutter, for recovering drops or segments not intended for printing (before they pass at the level of or through the outlet slot).

According to a first aspect of the invention, the cavity can comprise means, for example at least one spraying nozzle, in the cavity, for example in the $2^{nd}$ side wall and/or arranged in such a way as to emit a jet of cleaning fluid, for example a gas, such as air and/or solvent, from the $2^{nd}$ side wall of the cavity and/or which opens in this $2^{nd}$ side wall, in order to inject at least one cleaning fluid into the cavity.

At least one spraying nozzle can have a body at least partially cylindrical and comprise at least one nozzle or nozzle that opens into its cylindrical wall.

For example, at least one spraying nozzle makes it possible to inject a cleaning fluid into the cavity:

- at least in the direction of, or towards, the $1^{st}$ side wall;
- and/or towards the means for producing a plurality of ink jets in said cavity;
- and/or towards the gutter for recovering;
- and/or towards the means for sorting drops or segments of one or several of said jets intended for printing drops or segments that are not used for printing.

Means can also be provided, in the print head, for supplying at least said spraying nozzle with cleaning fluid.

The spraying nozzle can comprise at least one body, preferably of tubular or cylindrical shape, provided with a nozzle.

A print head according to the invention can further comprise an actuator of, or means for driving the, or at least one of said, spraying nozzle(s), for example of the type comprising a body at least partially cylindrical and comprising at least one nozzle that opens into its cylindrical wall, in rotation about an axis (x), for example an axis perpendicular to a direction of flow of the jets in the cavity and/or parallel to a plane in which a plurality of jets flow and/or an axis parallel to the plane of the nozzle plate for forming jets (or means for producing an ink jet), preferably in such a way that it can project a cleaning fluid into the cavity at least towards the means for producing at least one ink jet in said cavity and, after or before rotation, to the gutter for recovering.

For example said actuator or means make it possible to drive said spraying nozzle in rotation over an angle at least equal to 60° or 90° or 180°.

These actuator or means for driving said spraying nozzle in rotation comprise for example at least one motor (or electric motor) and a transmission or means of transmission between the motor and the spraying nozzle.

Preferably a seal or means for sealing are provided between, on the one hand, means for supplying at least said spraying nozzle with cleaning fluid and, on the other hand, the actuator or means for driving said spraying nozzle in rotation.

Thus, the latter being integrated into the print head, the risk of a flow or of a leak of cleaning fluid in the direction of the means for driving is reduced or prevented.

A print head according to the invention can further comprise means for evacuating at least one portion of a fluid injected, in particular with said spraying nozzle(s), into the cavity.

For example, at least one of the side walls can comprise at least one orifice, for example a slot, for evacuation.

According to a particular embodiment, the print head comprises at least one orifice for evacuating formed in the $2^{nd}$ side wall.

The print head can further comprise at least one orifice for evacuating formed in the $1^{st}$ side wall, preferably in the vicinity of the at least one nozzle or means in order to produce a plurality of ink jets in the cavity.

The presence of several orifices or channels for evacuation allows the print head to be used indifferently in several positions or orientations. In particular, when an orifice for evacuating is formed in each one of the side walls, and wherein the gutter for recovering can also be used as a channel for evacuation, there are at least three routes or channels for evacuating the cleaning liquid contained in the cavity.

According to a particular embodiment, a print head according to the invention can comprise an accelerometer, which will make it possible to provide information concerning the orientation of the print head. This accelerometer is for example arranged inside the cavity for the circulation of jets or inside a dedicated cavity with one or several electronic components, which can be located in the vicinity of the cavity for the circulation of jets.

Information relative to the orientation of the print head makes it possible, in particular when the print head comprises several zones or channels for evacuation, to optimise the cleaning sequences. In particular, it is possible to carry out a method of cleaning, separately or successively, of different zones and/or various zones or channels inside the cavity of the print head, with this method being according to the information relative to said orientation.

If the cavity comprises several orifices or channels for evacuation, the latter can advantageously be connected to the same actuation system, for example using the same pump.

In a print head according to the invention, an advantageous configuration is carried out when at least one spraying nozzle makes it possible to project a cleaning fluid in the form of a jet that diverges along an axis parallel to a flow direction of the ink jets and/or along an axis (x) according to which the nozzles for forming ink jets are aligned.

Preferably, at least one spraying nozzle makes it possible to project a cleaning fluid in the form of a jet that diverges with an angle between 1° and 20° along an axis parallel to a flow direction of the ink jets.

A print head according to the invention can be with a binary continuous jet.

A print head according to the invention can be of the CIJ type, comprising at least one charging electrode (in addition to the elements already mentioned hereinabove concerning a print head according to the invention) and one or several deviation electrodes (for example: two deviation electrodes parallel to one another). A sensor for detecting charges carried by the drops can also be provided in the CIJ print head. Possibly, the means, comprising for example at least one spraying nozzle, in order to inject at least one cleaning fluid into the cavity, arranged in said cavity, can project at least one cleaning fluid, for example following a possible rotation of these means in order to inject at least one cleaning fluid.

According to a particular embodiment, a print head according to the invention can comprise a closure of, or means for closing off, the outlet slot. Thus, during the cleaning operations carried out using means for injecting or projecting a cleaning fluid into the cavity, leaks of this liquid through the outlet slot are prevented, leaks that could lead to splashes or to stains on a support intended for printing. An evacuation of this liquid can be carried out, for example, by the gutter for recovering or, possibly, by a channel or channels or orifice(s) for evacuation such as mentioned hereinabove.

According to another aspect of the invention, which can be taken in combination, or not, with the first aspect hereinabove, a print head can comprise a $2^{nd}$ gutter, movable with respect to the first, between an open position and a closed position, in which an inlet of this $2^{nd}$ gutter is arranged facing the slot.

For example the cavity of a print head can comprise:

- another gutter, or a $2^{nd}$ gutter, for recovering drops or segments that are not deviated and not intended for printing, with this other gutter comprising an input or inlet slot and at least one suction channel;
- an actuator, or means for, driving the other gutter for recovering between a retracted position, in which it does not close off the outlet slot of the cavity, and a closed position, in which its input or inlet slot comes facing the outlet slot of the cavity, in such a way that a non-deviated jet, produced by the means for producing a plurality of ink jets in said cavity, exits from the cavity through the outlet slot and enters into the input or inlet slot of the $2^{nd}$ gutter for recovering;
- a seal, or means forming a seal, between the print head and the $2^{nd}$ gutter for recovering in the closed position of the latter.

According to an embodiment, the outlet slot is in, or is a part of, the $1^{st}$ gutter.

The invention also relates to an ink jet printer comprising:

- a print head according to the invention,
- a controller, or means for controlling the print head; preferably, this controller or these means for controlling are able to, programmed for, implementing a method for cleaning such as described hereinbelow;
- at least one circuit for supplying the print head with ink and with solvent,
- a controller, or means for, controlling the circuit for supplying the print head with ink and with solvent.

The invention also relates to an ink jet printer comprising:

- a print head according to the invention, of the type that comprises means for driving the spraying nozzle in rotation about an axis (x), for example an axis perpendicular to a direction of flow of the jets in the cavity and/or parallel to a plane in which a plurality of jets flow;
- a controller, or means for, controlling an actuator, or means for, driving said spraying nozzle in rotation; preferably, the controller, or means for controlling are able to, programmed for, implementing a method for cleaning such as described hereinbelow;
- at least one circuit for supplying the print head with ink and with solvent,
- a controller, of means for controlling the circuit for supplying the print head with ink and with solvent.

The invention also relates to a method for cleaning a print head according to the invention, with this head comprising at least one spraying nozzle, or means, in the cavity, for example in one of the side walls, for injecting or projecting a cleaning fluid into the cavity and/or a method for cleaning a print head such as described hereinabove and/or in this application.

In such a method, a cleaning fluid is injected or projected into the cavity using means, arranged themselves in the cavity in order to inject or project a cleaning fluid, for example in the direction of the at least one nozzle, or means for forming at least one ink jet, and/or in the direction of the $1^{st}$ side wall of the cavity.

The invention also relates to a method for cleaning a print head of the type that comprises an actuator, or means for, driving the spraying nozzle in rotation about an axis (x), for example perpendicular to a direction of flow of the jets in the cavity, the print head further comprising an accelerometer, with this method comprising the projecting of a cleaning fluid towards the inside of the cavity, according to a piece of information relative to the orientation of the print head given by the accelerometer.

For example, at least one of the following parameters can be a function of the information relative to the orientation of the print head:

- an orientation of said spraying nozzle(s) with respect to the inside of the cavity;
- and/or, if several successive pulses of solvent are projected, by said spraying nozzle(s) and/or by the means for producing at least one ink jet in said cavity, the duration of each pulse and/or the time difference between two successive pulses;
- and/or the evacuation of cleaning liquid, after the latter is projected into the cavity.

In a method for cleaning a print head according to the invention, the print head further comprising an accelerometer, one or more of the spraying nozzle(s) can have a plurality of possible orientations with respect to the inside of the cavity. The succession of orientations of the spraying nozzle(s) during the method of cleaning can then be a function of a piece of information relative to the orientation of the print head, given by the accelerometer: a $1^{st}$ succession of orientations is implemented for a 1st orientation of the print head, while a $2^{nd}$ succession of orientations, different from said 1st succession of orientations, is implemented for a $2^{nd}$ second orientation of the print head, different from the $1^{st}$ orientation.

The invention also relates to a method of cleaning according to the invention, or a method of cleaning a print head according to the invention, for example of the type comprising means for driving the spraying nozzle(s) in rotation about an axis (x), for example perpendicular to a direction of flow of the jets in the cavity and/or parallel to a plane in which a plurality of jets flow, comprising:

- the projecting of a cleaning jet towards the means for producing at least one ink jet;
- then the projecting of a cleaning jet towards the means for sorting drops or segments of one or several of said jets intended for printing drops or segments that are not used for printing and/or towards the gutter;
- then, again, the projecting of a cleaning jet towards the means for producing at least one ink jet.

The invention also relates to a method of cleaning according to the invention, or a method of cleaning a print head according to the invention, with this method comprising the projecting of several pulses of a cleaning jet alternating with pulses for ejecting solvent, in the cavity, by the means for producing at least one ink jet.

The invention also relates to a method of cleaning according to the invention, or a method of cleaning a print head according to the invention, with this method comprising the projecting of several pulses of a cleaning jet, with 2 successive pulses being separated by a duration chosen in such a way that, during this duration, a mixture of solvent and of ink, which results from the preceding pulse, can flow at least partially from the walls on which the cleaning liquid was projected but cannot dry. Thus, the later pulse will project cleaning liquid on a surface that is at least partially cleared, on the one hand of the cleaning liquid that was projected during the preceding pulse and, on the other hand, of the ink that was conveyed by this same cleaning liquid projected during the preceding pulse.

For example, each pulse is of a duration between 10 ms and 5 s, with 2 successive pulses of jet being separated by a duration between 500 ms and 5 s.

The invention also relates to a device for controlling an ink jet printer, for example of the binary or continuous jet (CU) type, able to, or specially programmed to, implement a method for cleaning or for controlling a print head such as described hereinabove or in this application.

BRIEF DESCRIPTION OF THE DRAWINGS

Embodiments of the invention shall now be described in reference to the accompanying drawings wherein:

FIG. 7A shows a spraying nozzle of a print head according to the invention and its means for driving in rotation;

FIGS. 7B and 7C show embodiments of a spraying nozzle of a print head according to the invention;

In the figures similar or identical technical elements are designated by the same reference numbers.

DETAILED DESCRIPTION OF EMBODIMENTS

Figure 1:
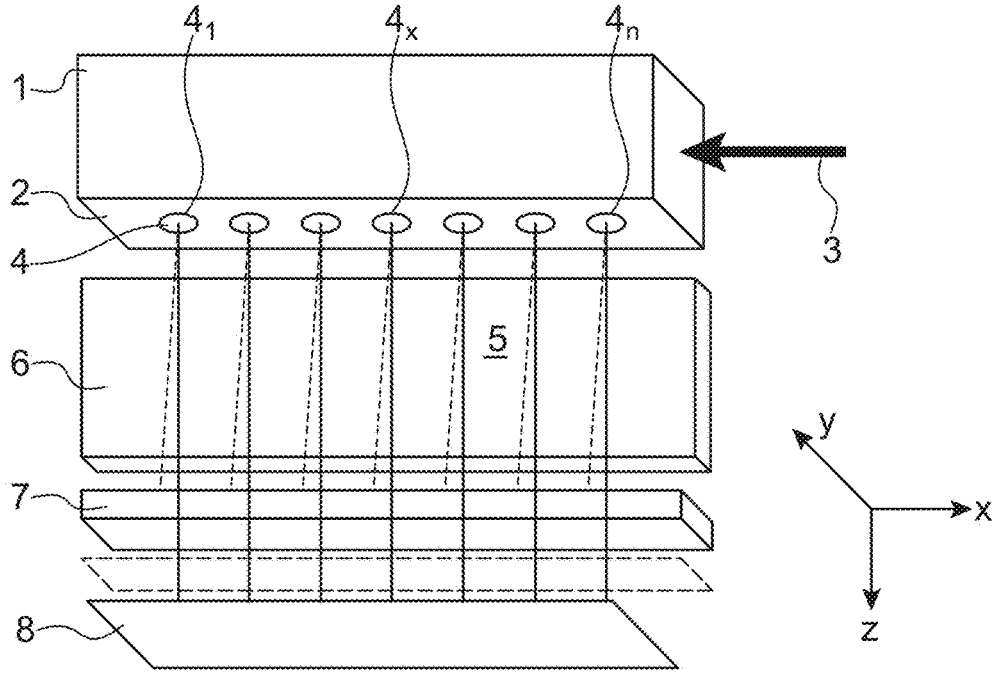
FIG. 1 shows an oblique projection of a print head, to which the invention can be applied, mainly showing the components of the print head located downstream of the nozzles.

A structure of a print head to which the invention can be applied is explained hereinbelow, in liaison with FIG. 1.

The head comprises a drop generator 1. This generator comprises a nozzle plate 2 on which are aligned, along an axis X (contained in the plane of the figure), a whole number n of nozzles 4, of which a first $\mathbf{4}_1$ and a last nozzle $\mathbf{4}_n$.

The first and last nozzles ($\mathbf{4}_1$, $\mathbf{4}n$) are the nozzles that are the farthest apart from each other.

Each nozzle has an axis of emission of a jet parallel to a direction or an axis Z (located in the plane of FIG. 1), perpendicular to the nozzle plate and to the axis X mentioned hereinabove. A third axis, Y, is perpendicular to each one of the two axes X and Z, the two axes X and Z extending in the plane of FIG. 1.

In the figure, the nozzle $\mathbf{4}_x$ is shown. Each nozzle is in hydraulic communication with a pressurised stimulation chamber. The drop generator comprises as many stimulation chambers as there are nozzles. Each chamber is provided with an actuator, for example a piezoelectric crystal. An example of the design of a stimulation chamber is described in document U.S. Pat. No. 7,192,121.

Downstream of the nozzle plate are means, or sorting block, 6 that make it possible to separate the drops intended for printing from the drops or segments of jets that are not used for printing.

The drops emitted or segments of jets, emitted by a nozzle and intended for printing, follow a trajectory along the axis Z of the nozzle and will strike a printing support 8, after having passed through an outlet slot 17. This slot is open onto the exterior of the cavity and allows for the exiting of the drops of ink intended for printing; it is parallel to the direction X of alignment of the nozzles, the axes of direction Z of the nozzles passing through this slot, which is located on the face opposite the nozzle plate 2. It has a length at least equal to the distance between the first and the last nozzle.

In the rest of this application as well as in the claims, the term "cavity" designates the zone of the space in which the ink circulates between the nozzle plate 2 and the outlet slot 17 of the drops intended for printing or between the nozzle plate and the gutter for recovering. The nozzle plate 2 forms in fact an upper wall of the cavity.

The drops emitted or segments of jets, emitted by a nozzle and not intended for printing, are deviated by the means 6 and are recovered by a gutter for recovering 7 then recycled. The gutter has, in the direction X, a length at least equal to the distance between the first and the last nozzle.

Figure 2:
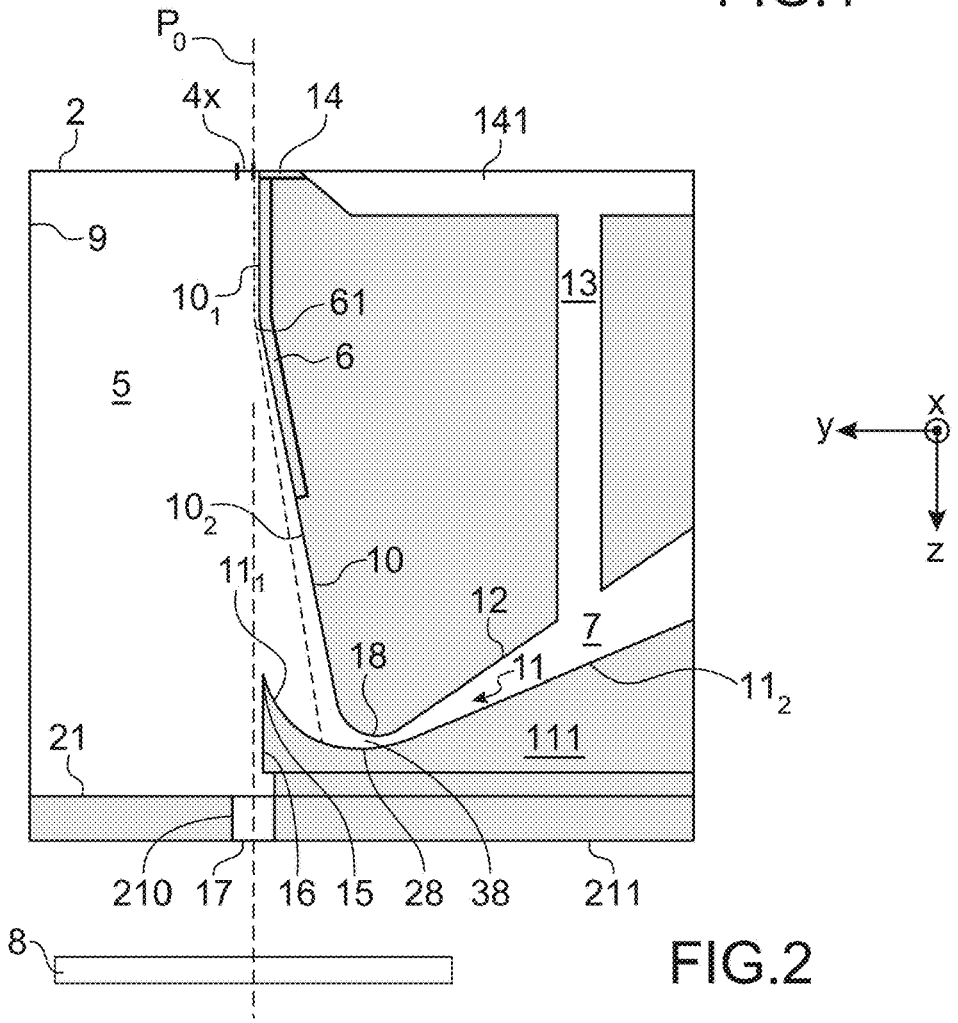
FIG. 2 shows a diagrammatical cross-section of a cavity of a print head, to which the invention can be applied, with this cross-section being taken along a plane parallel to the plane YZ and containing one of the axes Z of a nozzle.

A cross-section view of this structure of a print head is shown in FIG. 2. This cross-section is made along a plane parallel to the plane YZ, and containing the axis Z of a nozzle $\mathbf{4}_x$. The cross-section retains the same form over the distance going, in the direction X (perpendicular to the plane of FIG. 2), from the first nozzle $\mathbf{4}_1$ to the last nozzle $\mathbf{4}_n$. This figure shows the cavity 5 in which the jets circulate.

$P_0$ is used to designate the plane which passes through the nozzle 4*x* and which is parallel to the plane XZ. This plane is perpendicular to FIG. 2 and passes through all of the nozzles, which are aligned along X. It also passes through the slot 17. A lug of this plane is shown in FIG. 2 as broken lines.

The upper portion of the cavity is delimited by the wall 2, which also forms, or comprises, the nozzle plate or comprises the nozzles. The lower portion of the cavity is delimited by a lower wall 21, passed through by the slot 17, and by a portion of the gutter 7. Walls 9 and 10 limit the lateral extension, according to the Y axis. It can be noted that the notion of a portion or of "upper" or "lower" wall is to be understood in relation to the flow direction of the jet or jets in the cavity: indeed, the print head can be used to print a substrate arranged under the print head, as shown in FIG. 1 or 2; but the print head can be turned, with the jet being directed upwards, in order to print a substrate arranged above the print head (this configuration is not shown in the figures, but it is sufficient to turn FIG. 1 or 2 in order to obtain it). It can also be used in the horizontal position.

The cavity comprises in addition, on one side of the plane $P_0$, a side wall 9, preferably parallel to the plane $P_0$ and joining with the nozzle plate 2. A wall 10, located on the other side of the plane $P_0$, faces the wall 9. The cavity is therefore delimited, on either side of the plane $P_0$, by these 2 walls 9 and 10. By convention the side of the plane $P_0$ where the wall 10 and the gutter 7 are is called the first side of this plane, the other side (where the wall 9 is), is called the second side.

The wall 10 has ends, in the direction X, which are joined with the nozzle plate 2. In the portion close to the nozzle plate 2 and over a length that is, preferably, slightly greater than the distance between the first $\mathbf{4}_1$ and the last nozzle $\mathbf{4}_n$, this wall can comprise a slot 14, that will make it possible to suck the ink that has just been deposited on the nozzle plate or in the vicinity thereof.

At the bottom of this wall 10 is the input slot of the gutter for recovering 7 in order to make it possible to recover the drops which are deviated so that they do not pass through the slot 17.

The gutter can be placed in hydraulic communication with the slot 14, using a duct 13 that opens into the gutter and which is located at the rear of the wall 10 in relation to the plane $P_0$.

On the wall 10, are means 6, which are preferably flush with wall 10, for selecting and for deviating the drops that are not intended for printing. These means mainly comprise an electrode or electrodes. They are intended to be connected to means for supplying voltage, not shown in figure.

Preferably, the distance between the wall 10 and the plane $P_0$, measured in the direction Y, perpendicular to the plane $P_0$, is, starting from the plate 2, first of all constant; this corresponds to a $1^{st}$ portion $\mathbf{10}_1$ of the wall 10, which is substantially parallel to $P_0$.

Then, in a second portion $\mathbf{10}_2$, farther from the plate 2 than the $1^{st}$ portion $\mathbf{10}_1$, starting from a point 61 of inclination of the wall 10, the distance between the wall 10 and the plane $P_0$ increases with the separation of the nozzle plate.

This structure allows the wall 10 to be close to the plane $P_0$, and parallel to the latter, in a $1^{st}$ portion of the cavity located in the vicinity of the nozzles $\mathbf{4}_x$, where the path of the drops is hardly modified, even when the drops located farther downstream on this path are deviated in order to enter into the gutter for recovering 7.

This is what is seen in FIG. 2, where a path of drops is deviated towards the gutter 7: the upper portion of the jet is not, or is hardly, deviated, while, starting from a point 61 of inclination of the wall 10, the jet is increasingly moved apart, almost linearly, from the plane $P_0$. This can be considered a ballistic trajectory of the jet downstream of the electrostatic field zone.

A lower portion of the wall 10 and a wall 12, located at the rear of the wall 10 in relation to the plane $P_0$, define, by facing a wall 11, a duct, or gutter 7 for evacuating drops that will not be used for printing.

The walls 10 and 12 are, preferably, joined together, with the reference 18 designating the junction line of these two walls 10 and 12; this line is parallel, or substantially parallel, to the direction X. They form an upper wall of the gutter.

The wall 11 forms a lower wall of the gutter. It comprises a 1st portion $\mathbf{11}_1$, the most upstream in the direction of circulation of the drops in the duct 7, 70 and a second portion $\mathbf{11}_2$, the most downstream.

The possible duct 13 can open into the upper wall 12 and hydraulically connect the gutter for recovery 7 to a duct 141 hydraulically connected to the slot 14.

The reference 28 designates a junction line of the portions $\mathbf{11}_1$ and $\mathbf{11}_2$ of the wall 11; this line is parallel, or substantially parallel, to the direction X and to the line 18.

The portion $\mathbf{11}_1$ the most upstream, at the inlet of the duct 7 of the lower wall 11, ends with an end portion 15, which, advantageously, forms its apex (or top). This is the point of the surface 11 which is the closes to the plane $P_0$.

Preferably, this apex 15 is also part of a wall 16 which is parallel to the plane $P_0$ and which forms one of the walls surrounding or delimiting the outlet slot 17. In other words, the point the farthest upstream of the gutter is in line with the outlet slot 17 of the cavity. This makes it possible to optimise the recovery of the drops: thanks to this configuration, any deviated drop, even slightly, will be recovered by the gutter.

The slot 17 forms an opening of the cavity 5 through which pass the drops intended for printing. FIG. 2 shows as a dotted line a line that materialises the axis of the nozzle $\mathbf{4}_x$. This axis passes through the centre of the slot 17.

Another wall of the cavity is formed by the wall 21: it is substantially parallel to the plate 2, but the farthest away from the latter in the cavity 5. In other terms, it is located on the side of the outlet slot 17. An end of this wall can form an entry edge of the slot 17, facing the wall 16 already mentioned hereinabove.

A wall 210, substantially perpendicular to the wall 21, delimits, with the wall 16, the outlet slot 17: the drops will circulate between these 2 walls, before exiting from the slot 17 and becoming crushed on the printing support 8.

The reference 211 designates the outer surface of the cavity, into which the outlet of the slot 17 opens.

An example of the operation of this cavity is as follows.

A continuous jet of ink is emitted by the drop generator. The deflection of this jet is carried out or controlled by the electrode or electrodes 6 in order to create, according to a pattern to be printed and the position of the support 8, drops intended or not for printing.

According to an embodiment, segments of ink are generated, which are intended to not be printed, adjacent segments are able to be separated by a drop, which is intended to be printed. This technique is explained in document FR2906755 or U.S. Pat. No. 8,162,450. In such a case, the cavity:

- does not contain, downstream (in the direction of the flow of the jets or of the segments of ink) of the nozzle or nozzles, means, in particular electrodes, to charge the ink generated by the generator, in the form of drops or segments;
- contains means, in particular at least one electrode 6, in order to deviate the segments of ink generated by the generator; these means are connected to means for supplying with voltage;

In other embodiments, and in particular in the case of continuous ink jet printers (of which an example is given further on in liaison with FIG. 14) drops are formed, then possibly charged (with at least one charging electrode) and then possibly deviated (with at least one deviation electrode), according to the printing, or not, of the generated drops. The drops not used for printing are recovered in the gutter.

The drops intended for printing are displaced along the axis Z (in the plane $P_0$) and pass through the slot 17.

The drops, or the segments of ink, not intended for printing are deviated from the axis Z (or from the plane $P_0$), and follow a trajectory that leads them to strike the lower wall 11 of the gutter 7.

As the gutter is connected to a source of a vacuum, the ink that struck the wall 11, leaves, with air, the cavity 5 by the gutter.

Moreover, the duct 13 and the slot 14 can maintain a slight vacuum on the nozzle plate 2. This vacuum makes it possible to absorb ink that, via capillarity, is deposited on the nozzle plate 2.

A problem linked with this type of print head is the deposition of dirt (or projections of ink) inside the cavity, in particular on the electrode or electrodes 6 or on the walls 9, 10, or in the gutter 7 for recovering drops not used for printing.

Figure 3A:
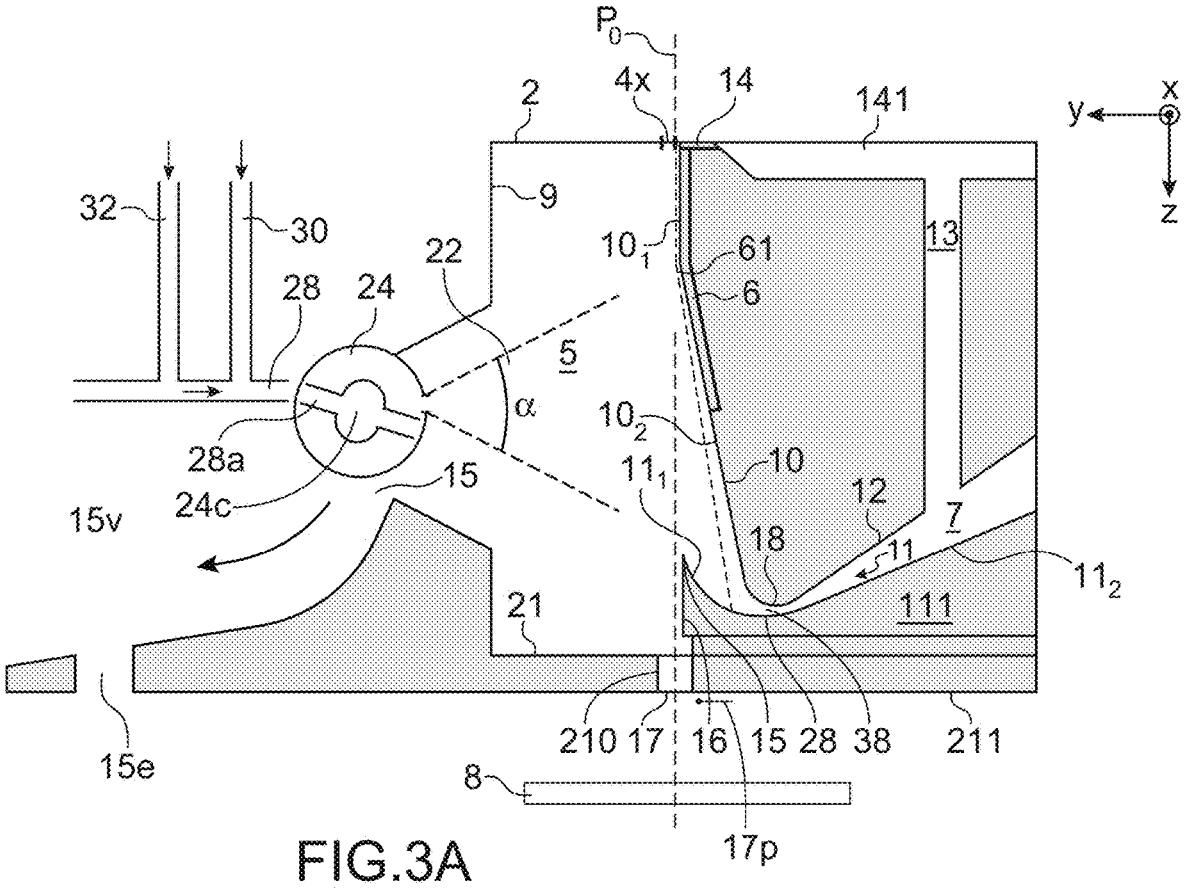
FIG. 3A shows a diagrammatical cross-section of a cavity of a print head, comprising, according to an aspect of the invention, means for forming a cleaning jet in the cavity; this cross-section being taken along a plane parallel to the plane YZ and containing one of the axes Z of a nozzle.
Figure 3B:
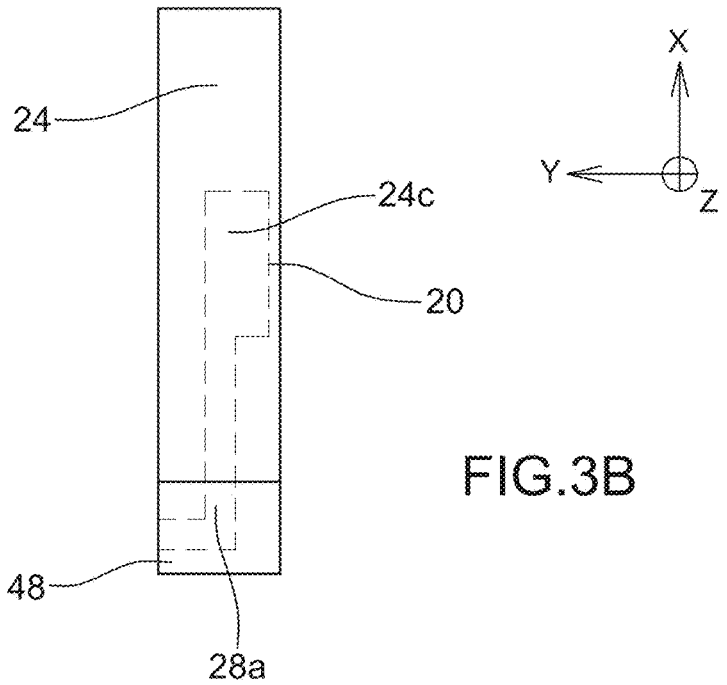
FIG. 3B shows a diagrammatical view of a spraying nozzle for a print head according to the invention.

An example of a structure of print head according to the invention is shown in FIGS. 3A and 3B.

This example includes most of the elements presented hereinabove in liaison with FIGS. 1 and 2. Consequently, numerical references identical to those of these figures designate therein the same elements, or corresponding elements.

In the example shown in FIG. 3A, at least one spraying nozzle comprising a nozzle 20, allowing for the projection of a fluid, is mounted in the wall 9, as shown in FIG. 3A; if the cavity comprises N nozzles $\mathbf{4}_x$ for forming jets, arranged along an axis parallel to the X axis, the cleaning jet 22 is preferably projected over the entire length of the cavity, measured according to the X axis. As shown in FIG. 3B, which is a top view, the spraying nozzle comprises an element, or spraying nozzle body, 24, for example of tubular or substantially cylindrical shape, whereon or wherein the nozzle 20 is mounted; the spraying nozzle is preferably rotating about an axis parallel to the X axis (as explained in more detail hereinbelow). FIGS. 7B and 7C show view of an embodiment of the spraying nozzle.

In the body of the spraying nozzle 24, a channel 24*c* for supplying with gas and/or with solvent makes it possible to bring cleaning fluid to the nozzle 20. This channel is interior to the body of the spraying nozzle 24, and it is itself supplied by a side feed channel 28*a* (FIG. 3A) which is made in an end part 48 (FIG. 3B) that makes it possible to direct the fluid supplied by means for supplying 28, 30, 32 to the channel 24*c* interior to the body of the spraying nozzle 24. This part 48 is fixed in relation to the print head if the body 24 of the spraying nozzle is rotating. This part 48 forms a connection between the means for supplying 28, 30, 32 and the channel 24*c*. According to an embodiment, the channel 28*a* is bent, as can be seen in FIG. 3B. This configuration favours the conveying of the fluid from the means for supplying 28, 30, 32 to the inner channel 24*c* of the body of the spraying nozzle.

Preferably, the means for supplying 28, 30, 32, made in the print head, comprise one or several channels, for example several channels for introducing air and/or solvent 30, 32; one and/or the other of these channels can for example be closed off by a valve, for example of the plunger type. For example, the channel 30 and the channel 32 can bring different fluids (one able to bring a gas, for example air, and the other solvent): means for closing off, for example a valve, for example also of the plunger type, make it possible to close off the channel 32 when using the fluid that passes through the channel 30, and/or means for closing off make it possible to close off the channel 30 while when using the fluid that passes through the channel 32. According to an embodiment, a common channel 28 is supplied by channels 30, 32. The channel 28 joins, at one of its ends, the channel 28*a* of the part 48. The outlet orifice of the nozzle 20 is preferably such that the cleaning jet 22 that exits therefrom is divergent: it is projected, in a plane perpendicular to the X axis, by widening from the nozzle 20, the jet is symbolised by broken lines in the cross-section view of FIG. 3A. The angle α, formed by the upper and lower limits of the jet, is for example between 1° and 20°.

Figure 4A:
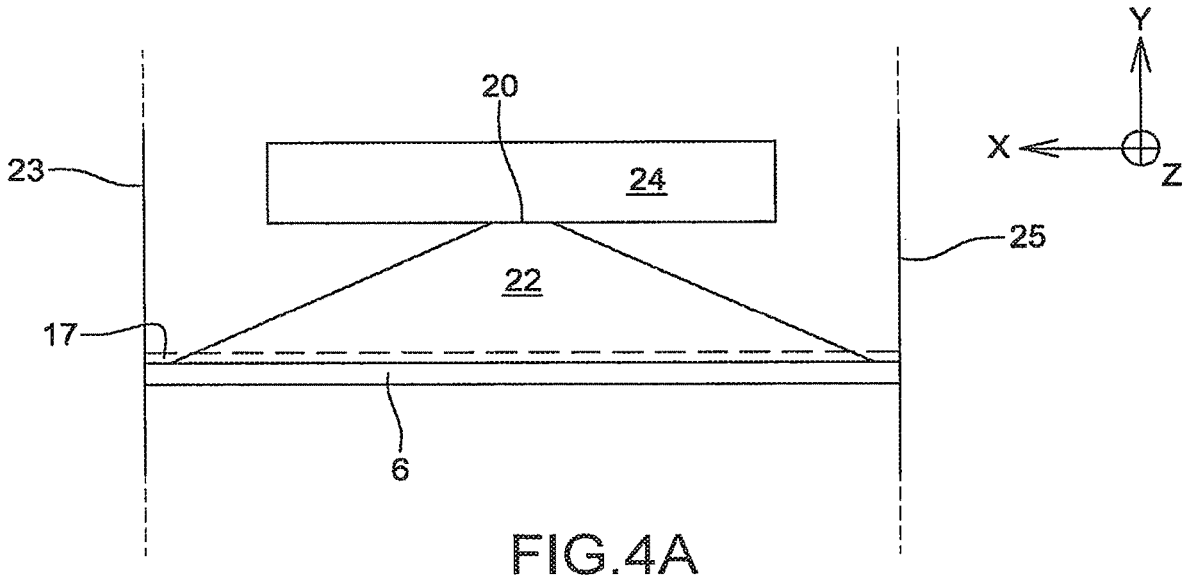
FIG. 4A shows a diagrammatical view of the top of a cavity of a print head according to the invention, with the emission of a cleaning jet into the cavity.

FIG. 4A is a top view of a preferred embodiment of geometry of the jet 22 projected: in this example, the cleaning nozzle 20 is designed so that the cleaning jet 22 diverges, in the plane xy, from the outlet of the nozzle 20. Due to this widening of the jet from the nozzle 20, practically the entire cavity (according to the X axis) can be cleaned. FIG. 4A shows the means 6 for deviating jets (arranged in or against the wall that faces the wall 9 from which the cleaning jet comes), the front 23 and rear 25 walls of the cavity and the spraying nozzle 24. The other elements of the cavity are not shown. But it is understood well, in this figure, that the cleaning jet can reach a large portion of the cavity, measured according to the X axis. If, in addition, the spraying nozzle 24 is rotating (about an axis parallel to the X axis), then it can successively reach the nozzles $\mathbf{4}_x$ for forming jets, then the means 6, then the suction slot of the deviated jets.

The nozzle makes it possible to project the solvent along a substantially rectangular surface, extended according to the length of the nozzle plate (therefore along the axis x); in other terms, each cross-section, according to a plane perpendicular to the X axis, is identical or substantially identical to the cross-section shown in FIG. 3A. Such a geometry for the projection of solvent makes it possible to obtain a good compromise between the effectiveness of the cleaning and the quantity of solvent used.

The walls of the nozzle 20 are therefore preferably oriented in order to obtain a shape of the jet 22 that is diverging, widening from the outlet of the nozzle 20, in the plane yz (FIG. 3A) as well as in the plane yx (FIG. 4A).

Figure 4B:
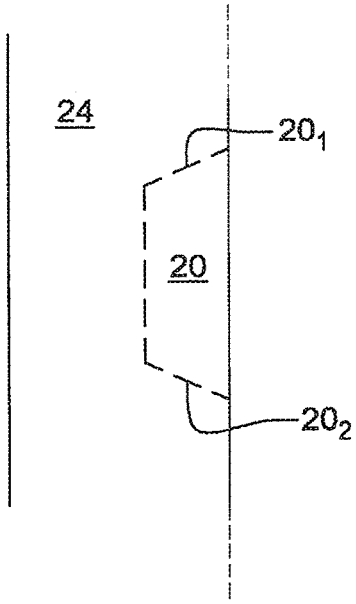
FIGS. 4B and 4C show the details of a spraying nozzle of a print head according to the invention.
Figure 4C:
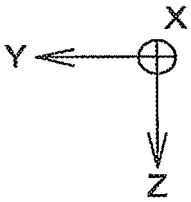
Figure 4C:
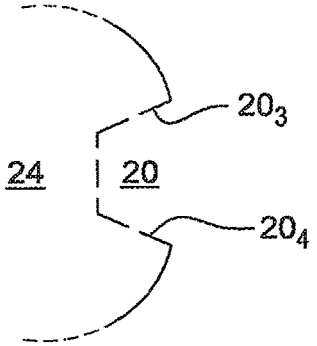

FIGS. 4B and 4C diagrammatically show examples of walls $\mathbf{20}_1$, $\mathbf{20}_2$, $\mathbf{20}_3$, $\mathbf{20}_4$ of the nozzle 20 that make it possible to favour this widening of the jet, in a plane xy as well as in the plane yz.

FIGS. 3A-4C show a device with a single nozzle 20. Alternatively, several cleaning nozzles 20, 20', 20" can be mounted in the cavity, as shown in FIG. 5A.

Figure 5A:
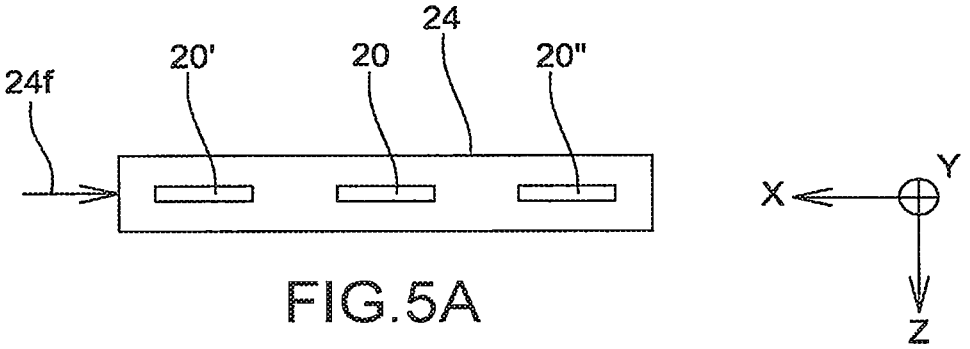
FIGS. 5A and 5B show alternatives of a spraying nozzle of a print head according to the invention.
Figure 5B:
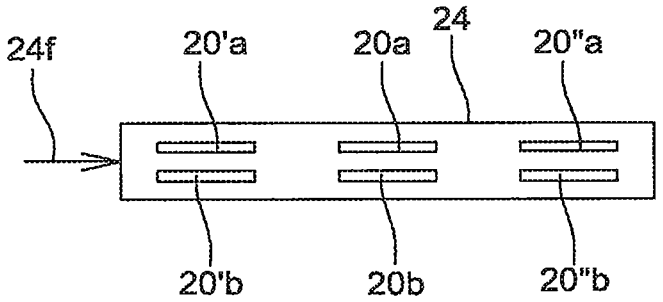

In FIG. 5A the nozzles are aligned along an axis (parallel to X). FIG. 5B shows an alternative wherein several nozzles 20*a*, 20*b*, 20'*a*, 20'*b*, 20"*a*, 20"*b* are arranged along different axes, parallel to x.

According to an embodiment, at least two of the nozzles 20, 20', 20" of FIG. 5A or at least two of the nozzles 20*a*, 20*b*, 20'*a*, 20'*b*, 20"*a*, 20"*b* of FIG. 5B make it possible to direct a cleaning fluid towards the various portions inside the cavity. According to an advantageous configuration, a nozzle makes it possible to direct a cleaning fluid towards the gutter for recovering drops.

Preferably, all of the nozzles make it possible to reach all the walls of the inside of the cavity; this can depend on the shape of the interior walls of the cavity. The embodiment shown in FIG. 8 and described further on in this application makes it possible to reach all of the interior walls of the cavity.

Preferably, each one of the nozzles of FIGS. 5A and 5B can emit a cleaning jet that has for example, seen from above, a diverging shape as shown in FIGS. 3A and 4A.

Figure 6:
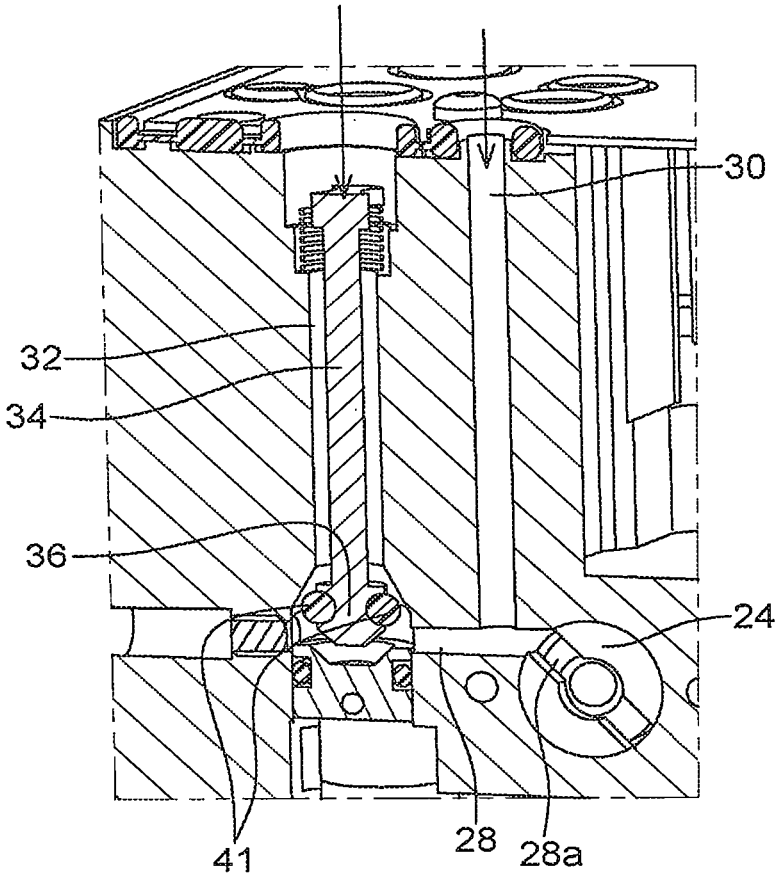
FIG. 6 shows means for supplying with cleaning fluid a print head according to the invention.

FIG. 6 shows an embodiment of the supplying with fluid(s) of the cleaning device according to the invention. A channel 32 for supplying comprises a valve 34, of the plunger type, provided with a head 36 that makes it possible to close off the end of the channel 32 when it is in the high position (the low position, open, being shown in FIG. 6). Thus, when a fluid (air and/or solvent) arrives via the channel 30 (because it was pressurised), it pushes the valve 34 upwards, which closes the channel 32. Inversely, a fluid (air and/or solvent) arrives under pressure via the channel 32, this fluid pushes the valve 34 downwards, which thus opens the channel 32. The head 36 of the valve 34 can be provided with means 41 (for example one or several seals) that ensure the seal of the closing of the canal 32 and when the valve is in its top position.

The fluid introduced into this system is then sent inside the spraying nozzle 24 (as symbolised by the arrows 24*f* of FIGS. 5A and 5B) by the intermediary of the channel 28*a* of the part 48.

As indicated hereinabove, preferably, the spraying nozzle 24 is rotating about an axis which is, preferably, parallel to the X axis, i.e. substantially perpendicular to a direction of flow of the jets in the cavity (but other orientations of this axis of rotation are possible, for example parallel to said flow direction of the jets and/or parallel to a plane in which a plurality of jets flow); means, in particular an electric motor, are provided to drive the nozzle in such a movement of rotation; it is therefore possible to carry out a rotation of the spraying nozzle 24 over a certain angle, for example at least 30° or at least 60° or 90°. According to an embodiment, the movement of rotation makes it possible to project a cleaning liquid, successively towards the N nozzles $\mathbf{4}_1$-$\mathbf{4}_n$ for forming jets, then towards the means 6 of deflection, then towards the gutter for recovering 11 (or in a different order). The entire cavity, or a substantial portion of the latter, can then be cleaned. It is also possible to carry out a rotation of the spraying nozzle 24 over an angle greater than 180°, for example up to 360°, so as to also be able to clean the portions of the system arranged behind the spraying nozzle 24 (when the nozzle is turned towards the cavity 5).

FIG. 7A is a cross-section view, along a plane parallel to the plane xz, of a portion of the print head, in particular of the spraying nozzle 24 (of which, because of the cross-section view, only one portion, the front portion, can be seen, and in particular the nozzle 20 does not appear); it shows how this spraying nozzle 24 can be driven in rotation.

The spraying nozzle 24 is inserted into a cavity 24*k* made in the print head, with a substantially cylindrical shape. If the spraying nozzle can be driven in rotation according to a sufficient angle, the inside of this cavity 24*k* can be cleaned by the jet coming from the nozzle 20. Means of sealing 52 can be provided between the spraying nozzle 24 and the surface of the cavity 24*k* in which it is arranged.

A motor 40 is arranged in a cavity 40*c* made also in the print head. Means of transmission 42 makes it possible to drive in rotation an axis 46, of which one end is inserted into an opening 24*o* with a substantially cylindrical shape made in the body of the spraying nozzle 24 itself. The axis 46 is also press-fitted into a part 44 present in the cavity 50*i* (between the cavity 24*k* and the cavity 40*c*), preferably with a general cylindrical exterior shape. This part 44 makes it possible to provide the seal with respect to the motor: for this purpose, the outer surface of this part 44 can advantageously be provided with means 50 that make it possible to provide the seal at the interface between its outer surface and the inner surface of the cavity 50*i*.

The part 44 can be driven in rotation by the axis 46 in the cavity 50*i*. Preferably, this part 44 is glued or brazed on the axis 46, the gluing or the brazing contributes to the seal of the system.

The axis 46 is enlarged, at its base, by a plate 46*p*, which is driven in rotation by a reduction box 42 which retransmits the movement imposed by the motor 40.

The movement of the latter is therefore transmitted to the axis 46 by the intermediary of the set 42, 46*p*, with the part 44 being driven in rotation while still ensuring a seal with the means 50.

The cleaning fluid is injected into the spraying nozzle 24 (more exactly into the cavity 24*c*) by the end of the latter opposite that located on the side of the means 40, 42, 46 for driving it in rotation. The cavity 24*c* extends along a portion of the spraying nozzle 24, while the opening 24*o* extends along another portion of the spraying nozzle 24.

If the device comprises the means of sealing 50, 52, liquid that would escape from the circuit for supplying with cleaning fluid would first be blocked by the means 52 for sealing, then by the means 50 and by the gluing or the brazing of the part 44 on the axis 46.

FIG. 7A also shows the channel 28*a* through which the cavity 24*c* is supplied.

This duct is arranged in fact in the part 48, which forms both a closure cap of the end of the body of the spraying nozzle 24 as well as a connector between the latter and the means for supplying 28, 30, 32. Means of sealing 49 can be provided between this cap 48 and the cavity 48*c* in which it is arranged. Here again, these means of sealing 49 makes it possible to obstruct any flow of the cleaning liquid outside of the channels wherein it circulates.

FIGS. 7B and 7C show 2 views of the spraying nozzle 24 wherein numerical references identical to those of the preceding figures are marked in order to designate therein the elements that have already been described hereinabove. The nozzle 20 for projecting is in particular present. When the spraying nozzle is driven in rotation about its longitudinal axis, the nozzle 20 is directed towards various portions of the cavity that it can thus clean. Alternatively, as already explained hereinabove in liaison with FIGS. 5A and 5B, the spraying nozzle 24 can comprise several slots for projecting cleaning liquid: the supplying with fluids is then the same as that described hereinabove, for example in liaison with FIGS. 3A, 3B, 6 and 7A and/or the spraying nozzle 24 can be driven in rotation in the same way as described hereinabove.

Means can be provided for carrying out a suction of the solvent projected into the cavity.

First of all, according to an embodiment, this suction is carried out by the gutter 7. Possibly, as shall be seen hereinbelow, a $2^{nd}$ gutter can be provided, which can also contribute to the suction of the cleaning solvent that streams in the cavity.

Moreover, solvent can be sucked by a suction slot 14 made at the top of cavity (FIG. 3), by the intermediary of a duct 141.

Finally, solvent can be sucked by a suction slot 15 made in the wall wherein the spraying nozzle 24 is positioned; this slot is shown in FIG. 3A, but also in FIG. 7A. The corresponding cleaning liquid can be driven towards the outside of the cavity by an evacuation slot 15*e*, shown in FIG. 3A, which can, for example, be extended by a suction duct, which can possibly be connected to the main suction circuit by means of a valve, which makes it possible or not to suck the liquid that is in the cavity. Advantageously, the wall has a locally pyramidal shape, with locally inclined side walls so that, regardless of the position of the print head, gravity favours the flow of the cleaning liquid.

Means for suction, for example a pump (not shown in the figures) can be specific to each suction channel, but are preferably common to the various evacuation channels.

The presence of the 3 evacuation routes mentioned hereinabove makes it possible to use the head in any position whatsoever, with the cleaning liquid able to be evacuated by the intermediary of any one of them whatsoever. Indeed, as already indicated hereinabove, the print head can be used as shown in FIGS. 1 to 3, with a printing support 8 being arranged under the head and the jet flowing from the nozzle to the slot 17, then towards the support 8; but it is also possible to use the print head in any other position, in particular in the position that is the reverse of that of FIGS. 1 to 3, with the printing support being arranged above the head, with the latter being turned over and the jet rising from 11 the nozzle to the outlet slot 17, in the direction of the support 8. As described elsewhere in this application, an accelerometer can make it possible to detect the position of the print head.

In order to reinforce the effectiveness of the means of suction, it is possible, during the operations of cleaning the inside of the cavity, to close the slot 17, for example with a plate 17*p*, shown in FIG. 3A, which can be actuated, for example switched, between an open position (as in FIG. 3A), and a closed position wherein it obstructs the slot 17. The actuating of this plate 17*p* can be manual or controlled by means for controlling such as the controller of the printer with which the print head is used. Another example of means for closing the slot is the use of a $2^{nd}$ gutter, that is movable, as explained hereinbelow. Regardless of the embodiment implemented, the closing of the slot makes it possible to force the liquid used for the cleaning of the inside of the cavity to flow through one of the suction routes mentioned hereinabove.

An example of the method of cleaning is as follows:

- the printing in progress is stopped;
- the nozzle 20 can then be brought to a reference position, for example marked using a mechanical stop linked to the body of the spraying nozzle 24;
- the cleaning nozzle 20 can be purged by the channel 15 (the spraying nozzle 24 then undergoes a rotation that leads to the nozzle 20 towards the volume 15*v* (see FIG. 3); alternatively, the nozzle is purged by being directed towards one of the elements to be cleaned (electrodes 6, gutter 7 or even nozzles 4*x*).
- then the cleaning jet is oriented towards the N nozzles $\mathbf{4}_1$-$\mathbf{4}_n$ for forming jets;
- then it is oriented towards the electrodes 6;
- then it is oriented towards the gutter 11;
- then, again, it is oriented towards the N nozzles $\mathbf{4}_1$-$\mathbf{4}_n$ for forming jets, in order to eliminate the projections of ink that could result from the cleaning phases of the electrodes 6 and of the gutter 11;

During each orientation of the nozzle 20, the cleaning liquid can be sent by pulses, for example pulses between 10 ms and 5 s, with each pulse being separated from the following one by a duration that can be about a few seconds, for example between 500 ms and 5 seconds. Possibly, these pulses can be synchronised with solvent ejection pulses by the printing nozzles $\mathbf{4}_x$. Indeed, the latter emit jets which are much more powerful than the jet emitted by the cleaning nozzle 20. It is then possible to carry out, successively: the emitting of a cleaning jet by the nozzle 20, then of jets by the nozzles $4_x$, then again the emitting of a cleaning jet by the nozzle 20 . . . etc. Furthermore, it is possible, after a projecting of cleaning liquid by the nozzle 20 towards the nozzles $4_x$, to suck solvent by these same nozzles $4_x$, which makes it possible to remove the impurities (that can result from the deposition of ink or of particles contained in the ink) which may have entered into the stimulation changers and in the ducts which are upstream of these same nozzles $4_x$.

The duration of separation of 2 successive pulses of cleaning liquid emitted by the nozzle 20 is preferably chosen in such a way that the mixing of solvent and of ink that is flowing due to the pulse of the preceding cleaning liquid has not yet dried. In other terms, this duration of separation is chosen so that said mixture has already been able to flow from the walls on which the cleaning liquid was projected (thus, the following pulse will not be ineffective) but also so that this mixture is not yet dry. Indeed, the drying can intervene rather quickly after a single pulse, in particular in the case of a solvent of the MEK (methyl-ethyl-ketone) type.

The invention was described hereinabove with the presence, in the wall of the cavity, of a spraying nozzle, movable or fixe, and provided with one or several nozzles for projecting cleaning fluid.

But the cavity can comprise several spraying nozzles, with each one being one of the types described hereinabove.

For example, the cavity can comprise at least one movable spraying nozzle and at least one fixed spraying nozzle. In particular, at least one fixed spraying nozzle can be positioned in order to direct a cleaning jet towards a specific zone, for example the gutter for recovering.

In the case, disclosed further on, wherein the print head further comprises a movable gutter:

- a rotating nozzle can be implemented in order to clean the various portions of the inside of the cavity, such as was disclosed hereinabove;
- while a fixed nozzle is provided to clean the inside of the movable gutter, when the latter is in the closed position of the cavity for forming jets.

Figure 13:
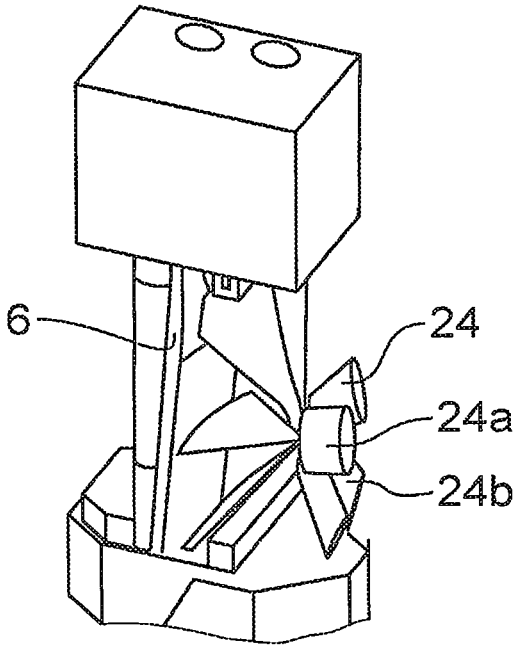
FIG. 13 shows a diagrammatical view of a cavity of a print head, comprising, according to an aspect of the invention, several spraying nozzles with different orientations in order to form several cleaning jets in the cavity.

FIG. 13 diagrammatically shows a cavity, such as it was described hereinabove but comprising a plurality of spraying nozzles (here 3 spraying nozzles are shown) 24, 24*a*, 24*b*, which are for example fixed and which are directed in such a way that the jets that they project make it possible to reach various portions inside the cavity. FIG. 13 does not show the wall 9 wherein the spraying nozzles are integrated. It can be seen, in this figure that one of the jets makes it possible to reach an upper portion of the cavity, preferably the nozzles $4_x$ for projecting ink jets into the cavity, while another jet is directed towards the electrode 6 and the third is directed towards the input slot of the gutter for recovering.

During a stopping phase of the machine, as no nozzle $4_x$ is producing any jet of ink, it is possible to carry out a cleaning, for example by at least one spraying nozzle (fixed or movable) and/or by ejecting solvent by the printing nozzles $4_x$.

An embodiment of the $1^{st}$ gutter 7 was given hereinabove, in liaison with FIG. 2.

Another embodiment (FIGS. 8-12B) can be taken in combination, or not, with the preceding one. The device then comprises 2 gutters, of which one is mobile in translation in relation to the print head.

A $2^{nd}$ gutter 70 is shown in FIGS. 8-12B, wherein the numerical references identical to those of the preceding figures designate therein identical elements. Thus, there is the electrode or the electrodes 6, the spraying nozzle 24, the nozzle 20, the $1^{st}$ gutter 7. It can also be seen, in this embodiment, that the slot 17 is located in the part wherein the $1^{st}$ gutter is made.

Figure 8:
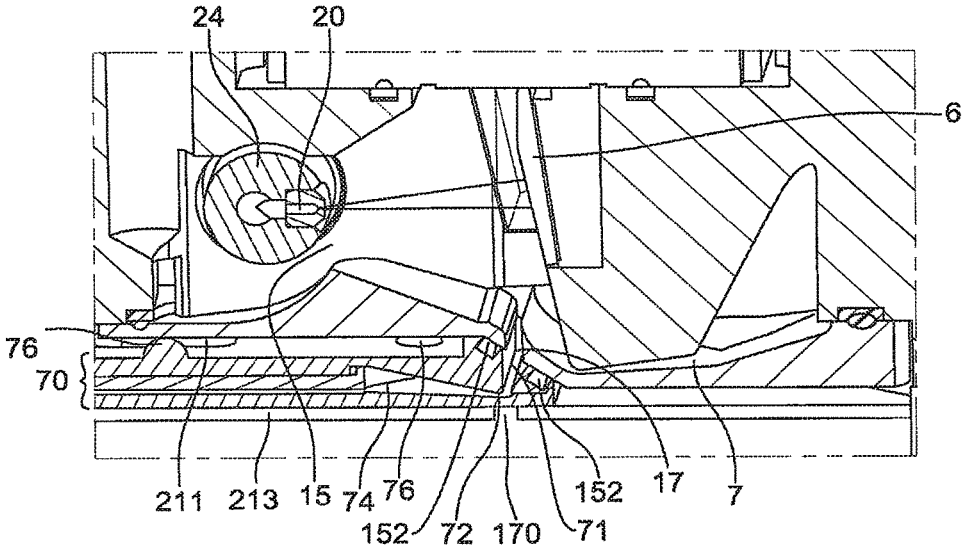
FIG. 8 shows another aspect of a cavity of a print head according to the invention, with a $2^{nd}$ gutter, movable, here in the closed position.
Figure 9:
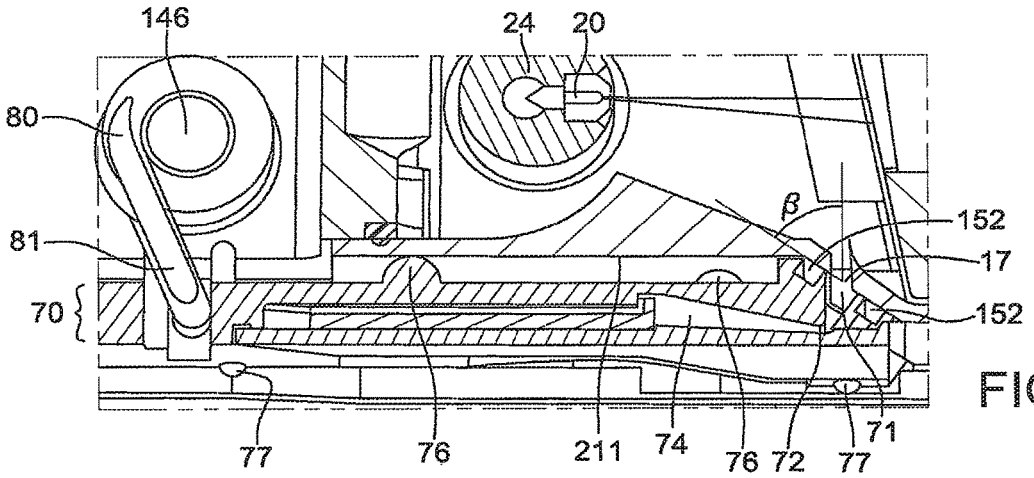
FIG. 9 shows a cavity of a print head according to the invention, with a $2^{nd}$ gutter, movable, and its means of return.

As can be seen in FIGS. 8 and 9, the $2^{nd}$ gutter 70 can comprise:

- a $1^{st}$ portion, which comprises an input slot 71 of the drops in this gutter; preferably, the width of this $1^{st}$ portion will, in the direction of circulation of the drops in the gutter, increasingly be reduced, with a surface of this $1^{st}$ portion forming an impact surface of the drops; this $2^{nd}$ gutter will, by the geometry of its $1^{st}$ portion (from the input slot 71 to the bend 72), accelerate the suction of the ink after impact of the drops on the impact surface, then convey the ink towards the restriction 72, which will form a non-return element;
- a restriction or a bend 72; the $1^{st}$ portion can be inclined from the input slot of the drops in the gutter to the restriction;
- a $2^{nd}$ portion 74, in order to remove the fluid mixture (liquid and gas, mixture that results from the impact of the drops on the impact surface) from the restriction 72.

Means can be provided to actuate this $2^{nd}$ gutter in translation, between a position, referred to as "closed" in which its input slot comes into the extension of the outlet slot 17 of the cavity, and a position, referred to as "open", of which the outlet slot 17 of the cavity is cleared.

For example, in the closed position, the inlet orifice 71 of the $2^{nd}$ gutter, mobile, is bearing against the outer surface 211 of the cavity, in such a way that its inlet slot 71 comes in the extension of, or in front of, the outlet slot 17 of the cavity, both slots facing each other (so that a drop of a jet flowing or circulating through the outlet slot 17 then flows through the inlet slot 71 and into the $2^{nd}$ gutter); preferably, the outer surface and/or the $2^{nd}$ gutter comprise(s) means for sealing 152 in such a way that the liquid cannot exit via the support zone of the $2^{nd}$ gutter against the outer surface 211 of the cavity; for example the $2^{nd}$ gutter comprises one or several seals that bear against the outer surface 211, in the vicinity of the outlet slot 17.

For example, this second gutter makes it possible to recover, at the start-up of the print head, both the initial solvent then the curtain of ink. It has, preferably, the same characteristics, in particular geometrical, as the main gutter.

The $2^{nd}$ gutter (or, in the embodiment that has just been described, its second portion 74) is also connected to means for sucking a fluid which is present in this $2^{nd}$ gutter, for example by the intermediary of a suction channel connected to the $2^{nd}$ portion 74; preferably, the means for sucking of the $2^{nd}$ gutter and those of the $1^{st}$ gutter are connected to the same means of pumping. Possibly, one or several solenoid valves make it possible, or not, to individually activate the operation of each one of these gutters. This second gutter, when it is in the closed position, also forms a means for sucking cleaning solvent that streams or flows in the cavity; it can therefore come as a supplement of the various channels for recovering already mentioned hereinabove.

According to an embodiment (FIGS. 8 and 9): an outlet face of the cavity is inclined in relation to the flow direction of the jets in the cavity (or axis z), for example by an angle β (see FIG. 9) between 10° and 80°; the input face of the $2^{nd}$ gutter is also inclined, substantially by the same angle, in such a way that the 2 faces come into contact with one another, or are facing, when the $2^{nd}$ gutter is in the closed position (as shown in FIGS. 8 and 9). This embodiment with inclined faces is favourable to a good sealing of the cavity when the $2^{nd}$ gutter is in this closed position.

The $2^{nd}$ gutter can be placed into a movement of translation according to a direction substantially perpendicular to the flow direction z of the jets in the cavity, in one direction, to its closed position, then in the other direction, from its closed position to its open position; for example a motor 140 (shown in FIG. 7A behind the motor 40) makes it possible, by the intermediary of means of transmission, to displace the $2^{nd}$ gutter to the position in which its inlet orifice 71 comes into the extension of the outlet slot 17 of the cavity (as explained above, so that a drop of a jet flowing or circulating through the outlet slot 17 then flows through the inlet slot 71 and into the $2^{nd}$ gutter); when it is no longer necessary to maintain the $2^{nd}$ gutter in the closed position, it is placed into movement in the opposite direction by the same means in order to return to its open position.

Means of return, for example a spring 80 (FIG. 9) make it possible to maintain the $2^{nd}$ gutter bearing in one of the open or closed positions; for example, the spring 80 is pre-tensioned, and maintains the second gutter in the open position. This spring is wound on an axis 146, which transmits the movement of the motor 140. The latter makes it possible to bring the $2^{nd}$ gutter 70 from the open position to the closed position; one end 81 of this spring is connected to the $2^{nd}$ gutter and drives the latter in translation; the gutter can be guided in its movement of translation by guide lugs, for example the lugs 76 of FIG. 8. These lugs 76 allow the gutter to slide against the outer surface 211 of the cavity. Lugs 77 (not able to be seen in FIG. 8, but visible in FIG. 9; note, with respect to these 2 figures, the simplified nature of FIG. 10), located under the $2^{nd}$ gutter, allow the latter to slide against the inner surface of a cover 213. Laterally, the gutter can be guided in translation also by lugs 78 (of which one can be seen in FIG. 11) which slide against side walls, for example of the cover 213, between which it can come and go between its closed position and its open position.

Preferably, for reasons of space, the $2^{nd}$ gutter is arranged, in relation to a plane such as the plane P0 of FIG. 2, on the side opposite the fixed gutter. Furthermore, this arrangement makes it possible to carry out a single movement of translation of the movable gutter.

Figure 10:
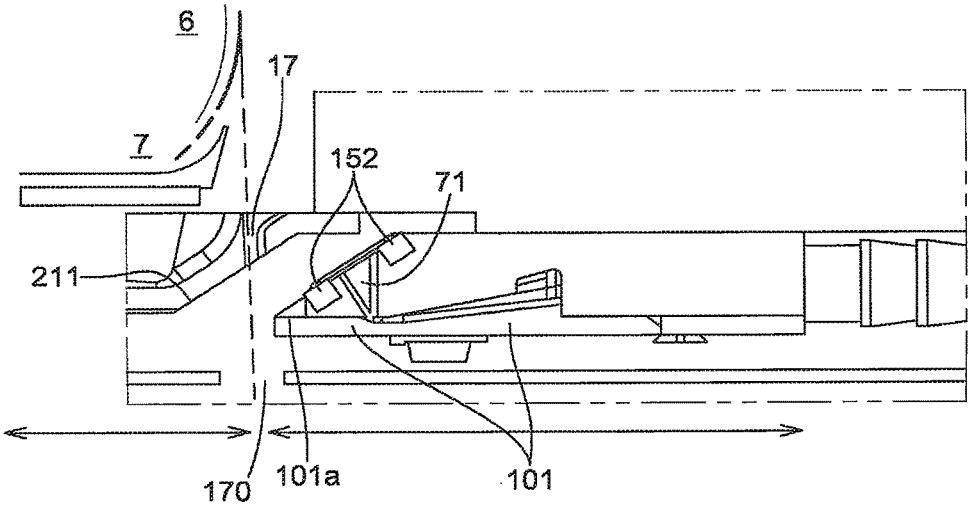
FIG. 10 shows a cavity of a print head according to the invention, with a $2^{nd}$ gutter, movable, in the open position.

FIG. 10 shows a situation wherein the $2^{nd}$ gutter is in the open position, the ink jet able to exit and be projected onto a printing support; the $1^{st}$ gutter operates in the usual way, in order to recover the drops of deviated jets.

Figure 11:
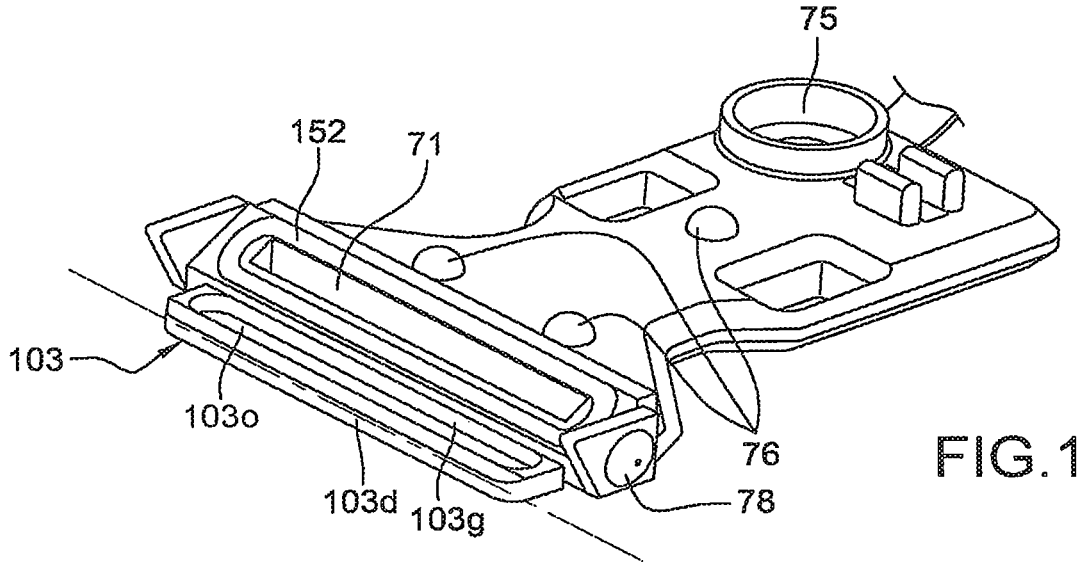
FIG. 11 shows an embodiment of a $2^{nd}$ gutter, movable, for a print head according to the invention.

FIG. 11 is a perspective view of an embodiment of a movable gutter, that can be incorporated into a print head of the type described hereinabove.

Its inlet slot 71 is surrounded by a seal 152 which makes it possible to provide the seal when it comes facing the outlet 17 of the cavity, in the closed position (as in the FIGS. 8 and 9). An orifice 75 can also be seen through which the atmosphere and the liquids sucked by the input slot 71 will be removed towards a suction circuit not shown in the figures.

As already indicated hereinabove, it is possible to carry out a print head with 2 gutters, one fixed and the other movable, without means for projecting a cleaning jet into the cavity (i.e. without the elements described hereinabove in liaison with FIGS. 3-7C).

The $2^{nd}$ gutter can be brought into a closed position:

- during the operations of cleaning the inside of the cavity, for example in the case of the presence of a cleaning nozzle 20 inside the cavity;
- and/or during the start-up of the print head, even though the ink jets are not yet deviated: it then makes it possible to recover the ink of these jets.
- and/or for, after a cleaning, not dry the inside of the cavity: for example, it is thus possible to maintain in the cavity air saturated with solvent vapour thanks to the seal provided by the closing of the cavity using the $2^{nd}$ gutter; possibly, it can also be provided a reserve of solvent that makes it possible to maintain this saturation in solvent vapour. Such a saturation with solvent vapours makes it possible to prevent the drying of the nozzle or nozzles for forming jets and the fixing of any impurities, it thus makes it possible to guarantee better starting of the jets;

An example of a method of cleaning that implements a cleaning nozzle 20, according to one of the embodiments described hereinabove in liaison with FIGS. 3-7C is the following:

- stopping of the printing in progress (in particular: stopping of jets, and then possible sending of solvent through the nozzles $\mathbf{4}_x$);
- closing of the $2^{nd}$ gutter;
- cleaning (via solvent) using the nozzles $\mathbf{4}_x$, and/or using means 24 forming a spraying nozzle in the cavity, as shown in FIGS. 3A-7C, with recovery of the solvent-ink mixture by the $2^{nd}$ gutter; this step of cleaning can be carried out according to one of the embodiments already disclosed hereinabove;
- stopping of the jet 22 of cleaning solvent;
- possibly: drying (if printing resumes immediately after cleaning);
- opening of the $2^{nd}$ gutter,
- possibly: resuming the printing (in particular: restarting of the jets).

This type of cleaning can be carried out regularly and/or in the presence of dirt, and/or during stopping and restarting phases of the printer.

During these operations, one and/or the other gutter can be cleaned using a spraying nozzle (for example the spraying nozzle 24 of FIG. 13) that is dedicated to it and therefore the jet is directed towards it.

The $2^{nd}$ gutter can be provided with conductive means in order to detect electrical charges carried by drops or segments of ink jets that it will recover.

Thus, it can be seen in FIG. 10 that at least one portion of the base of the movable gutter comprises at least one conductive portion 101 against which the charged drops will come into contact as soon as they penetrate into this $2^{nd}$ gutter. This conductive portion can be connected to means for detecting, for example means for counting detected charges or for measuring current (for example an ammeter), which will make it possible to measure the charge thus recovered.

These means for detecting are therefore active when the gutter is in the closed position and, for example, charges are detected although all of the jets should be deviated towards the $1^{st}$ gutter, fixed.

However, it is also possible to provide means that will make it possible to detect the presence of a jet or of charged drops, even when the $2^{nd}$ gutter is in the open position.

In this embodiment the drops can be charged using means (for example:

a voltage generator) in order to apply a voltage to the drop generator.

Thus, in FIG. 10, the conductive means 101 comprise a spout (or protruding portion) 101*a* which will make it possible, when the movable gutter is in the open position, to detect (without contact) the presence of a jet, of which the drops are charged, when the latter exits through the slot 17 of the device.

Figure 12A:
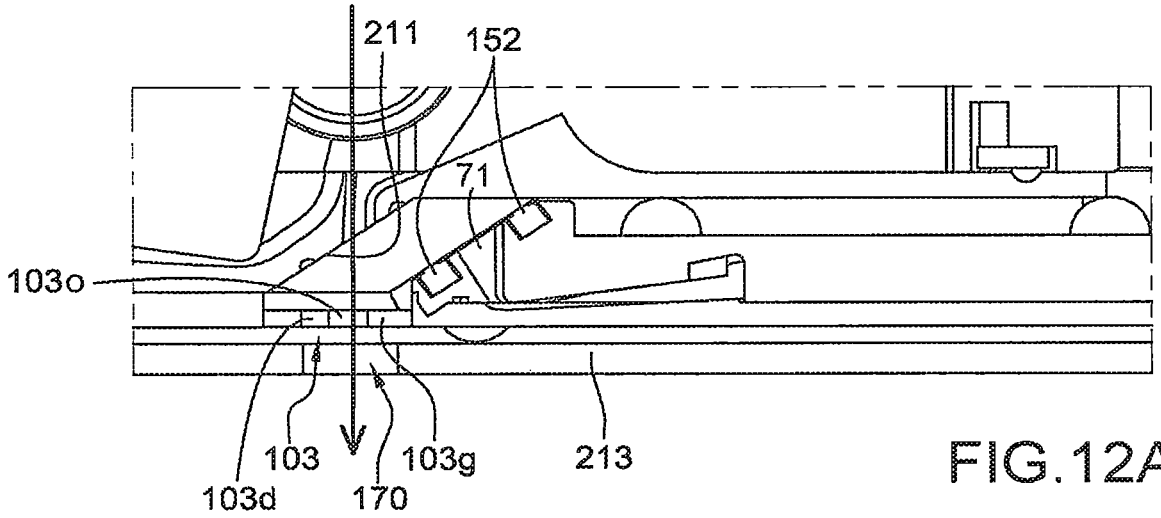
FIGS. 12A and 12B show a $2^{nd}$ gutter, movable, in the open position then in the closed position.
Figure 12B:
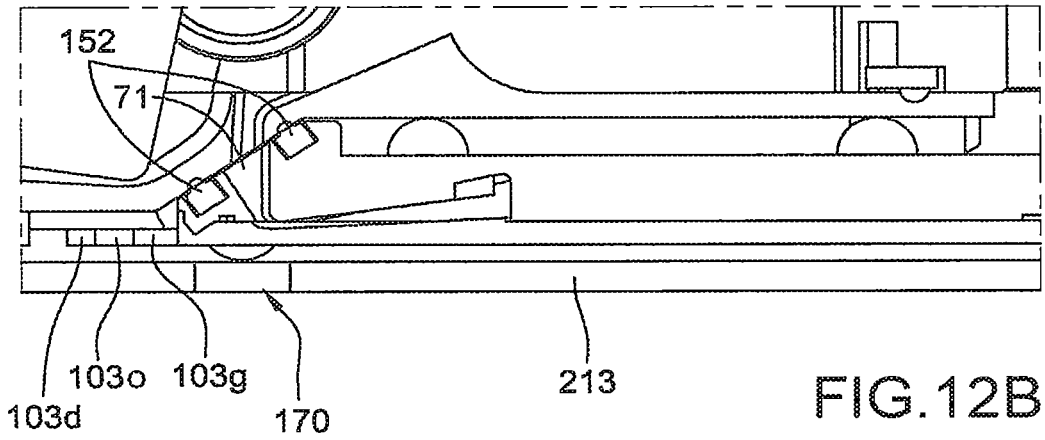

Alternatively, and as shown in FIG. 11 and in FIGS. 12A-12B, conductive means 103 form a slot or a ring (with a central opening 103*o*) which can be of a shape identical or similar to that of the outlet slot 17 of the device, and through which the jets that exit from the latter will pass (after having passed through the slot 17). Here again, these means make it possible, when the movable gutter is in the open position, to detect (without contact) the presence of a jet, of which the drops are charged, when the latter exits through the slot 17 of the device.

It is thus possible, for example, to detect the presence of a jet that is exiting through the slot 17 although it should be deflected towards the $1^{st}$ gutter.

Preferably, the conductive means 103 in the form of a slot or ring have a conductive portion 103*d*, 103*g* (FIGS. 11-12B) on either side of the through jets. Thus, if a jet is far from one of the 2 conductive portions, the charge induced in the conductive portion farther away is lower than if the jet were correctly centred in the ring, but this is offset by the charge induced in the other conductive portion, thus closer to the jet and which is then stronger. In other words, a symmetrical structure on either path of the jets makes it possible to offset the variations in charge induced by the spatial instabilities of the jet.

FIG. 12A shows the $2^{nd}$ gutter in open position, with a jet successively passing through the outlet slot 17, the opening 1030 of the means 103 and the slot 170 made in the cover 213. If the jet is charged, it induces charges in the means 103, charges that can then be detected.

Regardless of the embodiment chosen for these conductive means 101*a*, 103, the latter can be connected, for example via the conductive means 101, to means for detecting, for example means for counting induced charges detected (for example an ammeter). It is thus possible to measure the charge induced by the charges contained in the jet of drops that pass in the vicinity.

Consequently, even in the open position, the $2^{nd}$ gutter can play the role for a measurement of the jets.

FIG. 12B shows the $2^{nd}$ gutter in the closed position. The portions such as the spout or protruding portion 101*a* or the means 103 will then make it possible to detect short-circuits that are produced when a deposition of ink occurs between these means and another conduction portion, brought to a different potential, for example the cover 213. Such a short-circuit will introduce a variation in the signal in the means for detecting. The spout 101*a* or the means 103 can then ensure a function of detecting, even in the closed position of the $2^{nd}$ gutter.

The methods for cleaning described hereinabove can be implemented with a device provided with a second movable gutter, with the advantages that have just been explained in liaison with the presentation of the latter.

Whether the print head is of the type described hereinabove in liaison with the presence of at least one cleaning spraying nozzle in the cavity, for example according to one of the FIGS. 3A-7C and/or comprises a second movable gutter, for example according to one of the FIGS. 8-12B, a print head according to the invention can be provided with an accelerometer, for example located in the cavity for the circulation of jets or in a cavity, for example dedicated to electronic means, and in the vicinity or contiguous with the cavity for the circulation of jets.

An accelerometer makes it possible in particular to provide a piece of information on the orientation of the print head (such as already indicated, the latter can be in the position shown in FIG. 2, but also in the inverted position in relation to that of FIG. 2 or even in horizontal position, or in any other intermediate position between those mentioned hereinabove).

This information makes it possible to adapt the cleaning strategy according to the orientation of the head by acting:

- on the order of the cleaning steps, for example according to the risk of dirt by runs or flows that follow gravity: for certain orientations, which favour a flow of solvent or of liquid towards a particular zone of the cavity, it can therefore be preferred to start a cleaning of this same zone;
- and/or, in the case where the head comprises several channels for evacuation, on the distribution of the suction according to the various evacuations by favouring the one towards which the solvent naturally flows by gravity: here again, certain orientations will favour a flow of solvent, or generally, of liquid, towards a particular evacuation; it will therefore be preferred to distribute the suction from this evacuation.

An accelerometer also makes it possible to detect movements of the print head, and to then implement cleanings that are more frequent than when no movement is detected.

Finally, such an accelerometer allows for the detection of high vibrations and/or accelerations, that can explain printing quality problems.

An accelerometer can in particular make it possible to detect the orientation of the print head, the latter able to be oriented in order to print upwards (i.e. the jet is projected from bottom to top), or downwards (i.e. the jet is projected from the top to the bottom), or according to any other direction.

When a print head is oriented to print upwards (i.e. the jet is projected from bottom to top), a cleaning sequence of the inside of the cavity is preferably carried out in such a way that the cleaning begins with the portions located in the upper position, in such a way that the liquid flows via gravity inside the cavity, but not on portions that are already cleaned.

An example of a cleaning sequence shall be given for a print head comprising means such as described hereinabove in liaison with FIGS. 3A-7C in order to clean the inside of the cavity and a movable gutter as described hereinabove in liaison with FIGS. 8-12B, the print head being provided with an accelerometer as described hereinabove. When this print head is oriented to print upwards, the cleaning sequence can be as follows:

- projection of solvent towards the main gutter 7, and suction of the solvent by the latter;
- projection towards the movable gutter (which is then in the closed position of the cavity), and suction of the solvent by this movable gutter;
- projection of solvent towards the means 6 for sorting drops, and suction via slot 14 (FIG. 2);
- projection towards the means $\mathbf{4}_x$ for producing ink jets, and suction via the slot 14.

This sequence makes it possible to directly clean the various surfaces inside the cavity and to select the suction channel that is most suited for draining the latter (taking account of gravity).

In the case of a conventional orientation (such as shown in FIG. 1, the jets being directed from top to bottom) of this print head, this sequence can be implemented in the reverse order, by starting with cleaning the means $\mathbf{4}_x$, then the means 6 and finally the gutters. The latter make it possible to recover the solvent regardless of the portion which is cleaned, which is not the case when the orientation is reversed.

In the same way a specific sequence can be executed for any other orientation of the head, for example horizontal.

In a method for cleaning a print head according to the invention, the print head further comprising an accelerometer, one or more of the spraying nozzle(s) can therefore have a plurality of possible orientations with respect to the inside of the cavity. It is as shown in the examples hereinabove, the succession of orientations of the spraying nozzle(s) during the method of cleaning can then be according to a piece of information relative to the orientation of the print head, given by the accelerometer: a 1st succession of orientations is implemented for a $1^{st}$ orientation of the print head, while a $2^{nd}$ orientation succession, different from said $1^{st}$ succession of orientations, is implemented for a $2^{nd}$ second orientation of the print head, different from the $1^{st}$ orientation.

In the case of means such as the means for closing 17*p* (FIG. 3A) or of a movable gutter that can be positioned in such a way as to close the cavity as explained hereinabove (the position of FIGS. 8 and 9), it is possible, during the stopping or stand-by of the machine, to close the cavity, preferably in a sealed way, while still leaving in the latter solvent that has not been sucked in the cavity. In the case of a volatile solvent, it will evaporate until the air in the cavity is saturated with its vapours. The amount of solvent left in the cavity is chosen in order to saturate the air in the cavity with solvent vapour and keep some solvent in liquid phase, to avoid desaturation of the air in the cavity even in case the cavity isn't perfectly sealed.

Thanks to the presence of solvent vapours in the cavity, the residual ink present in the cavity and particularly on the nozzles does not dry. During the next starting the quantity of solvent used is therefore reduced and the cleanliness of the head is improved.

The means for cleaning the inside of a cavity, using at least one nozzle 20 arranged inside the latter were described hereinabove in the case of a binary continuous ink jet printer.

However, identical or similar means can be implemented in the framework of a continuous ink jet printer (CIJ).

Figure 14:
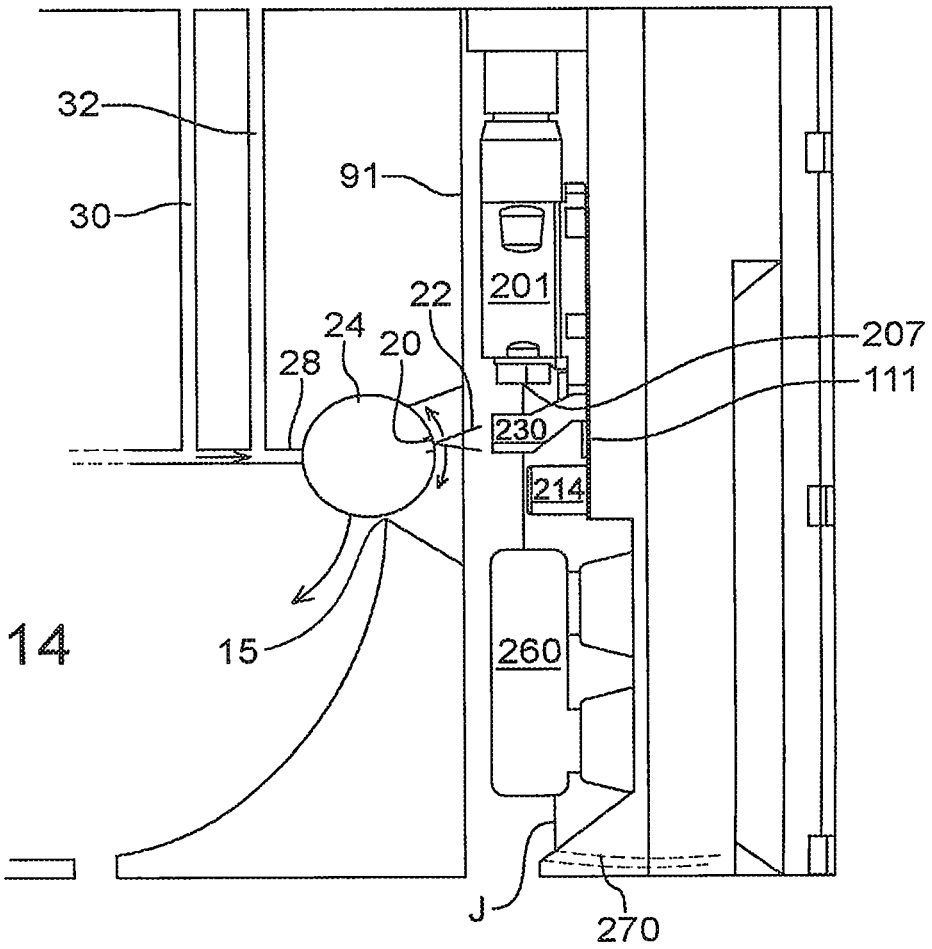
FIG. 14 shows an embodiment of a print head according to the invention, of the CIJ type.

FIG. 14 shows a CIJ print head, which comprises from upstream to downstream in the flow direction of the ink jet J:

- the ink drop generator 201 supplied with electrically conductive ink and capable of emitting a continuous jet J of ink through an ejecting nozzle 207. The initial trajectory of the jet is then confounded with the axis Z of the nozzle 207;
- one or several charging electrodes 230;
- possibly a sensor 214 that detects the charge actually carried by a drop of ink; this sensor is represented because certain printers have one of them;
- one or several deviation electrodes 260 of drops of ink electrically charged by the charging electrodes 230;
- a fixed gutter for recovering 270 ink not used for printing;
- possibly, a movable plate 17*p* for closing the cavity, preferably in a sealed manner, in particular according to what was described hereinabove.

Such a print head can possibly comprise at least one device for detecting the directivity of the trajectories of the drops and/or at least one electrostatic sensor, such as described in document WO 2011/12641.

The generator 201 comprises in addition means for stimulation of the ink, for example a piezoelectric actuator.

It can be seen, according to FIG. 14, that the cavity that comprises these various elements is delimited laterally by 2 side walls 91 and 111.

The charging electrode or electrodes 230 and the deviation electrode or electrodes 260 are fixed to, or arranged against, the wall 111.

The left portion of FIG. 14A, including the wall 91, shows a cleaning device such as already described hereinabove in liaison with FIGS. 3A-7C. Here in particular are the jet 22, the spraying nozzle 24, the nozzle 20, the supply ducts 28, 30, 32 and the evacuation channel 15.

It can be seen that the device already described hereinabove, in particular with the use of one or several cleaning nozzles, is entirely compatible with a print head architecture of the CIJ type. The jet projected using the spraying nozzle makes it possible in effect to clean the portions of the head which are arranged against the wall 111. FIG. 14 shows a jet which is projected in the direction of the charging electrodes 230. Via rotation, and/or via incorporation of several nozzles (as mentioned hereinabove in liaison with FIGS. 5A-5B) and/or of several fixed or movable spraying nozzles (also as mentioned hereinabove), it is entirely possible to clean the other portions of the head, in particular the nozzle 207, and/or the sensor 214, and/or the electrodes 260 and/or the gutter for recovering 270.

The various aspects already described hereinabove and relating to the method or methods of cleaning can be applied to the print head structure of the CIJ type, such as the one of FIG. 14.

A print head of the CIJ type, such as the one of FIG. 14, can be provided with means for closing the cavity, such as the means 17*p* of FIG. 3A or a second gutter, movable, as explained hereinabove in liaison with FIGS. 8-12B: it is then possible to carry out a closing of the cavity, preferably in a sealed manner, in order to carry out a cleaning, for example according to one of the embodiments explained hereinabove; it is also possible, using the possible second movable gutter, brought to closed position, to recover the solvent used during a cleaning operation.

A device according to the invention is supplied with ink by a reservoir of ink not shown in the figures. Various means of fluidic connection can be implemented to connect this reservoir to a print head according to the invention, and in order to recover the ink that comes from the gutter for recovering. An example of a complete circuit is described in U.S. Pat. No. 7,192,121 and can be used in combination with this invention.

Regardless of the embodiment considered, the instructions, in order to activate the means $\mathbf{4}_1$-$\mathbf{4}_n$ for producing ink jets and the means for pumping the gutter, and/or for controlling a cleaning in the cavity and/or for controlling the displacement of the movable gutter 70, are sent by the means for controlling (also called "controller"). It is also these instructions that will make it possible to circulate the ink under pressure in the direction of the means $\mathbf{4}_1$-$\mathbf{4}_n$, then to generate the jets according to patterns to be printed on a support 8. These means for controlling are for example carried out in the form of an electric or electronic circuit or a processor or a microprocessor, programmed to implement a method according to the invention.

It is this controller that controls the means $\mathbf{4}_1$-$\mathbf{4}_n$ for producing one or several jets of ink and/or of solvent, and/or the means for pumping of the printer, and in particular of the gutter, and/or the cleaning spraying nozzle or nozzles 24 of the cavity (in particular their orientation) and/or the opening and the closing of valves on the path of the various fluids (ink, solvent, gas).

This controller, or these means for controlling, can also memorise data, and possible process it, for example:

measurement data of the levels of ink in one or several reservoirs, and possibly processing it;

and/or data supplied by an accelerometer and the possible processing of it making it possible to deduce a piece of information relative to the orientation of the print head.

This controller, or these means for controlling, comprises the instructions for implementing a method of cleaning according to this invention and/or for controlling the displacement of the movable gutter 70 according to this invention.

This controller can also receive the data from an accelerometer and control the cleaning and/or the suction of cleaning solvent according to the orientation of the print head.

Figure 15:
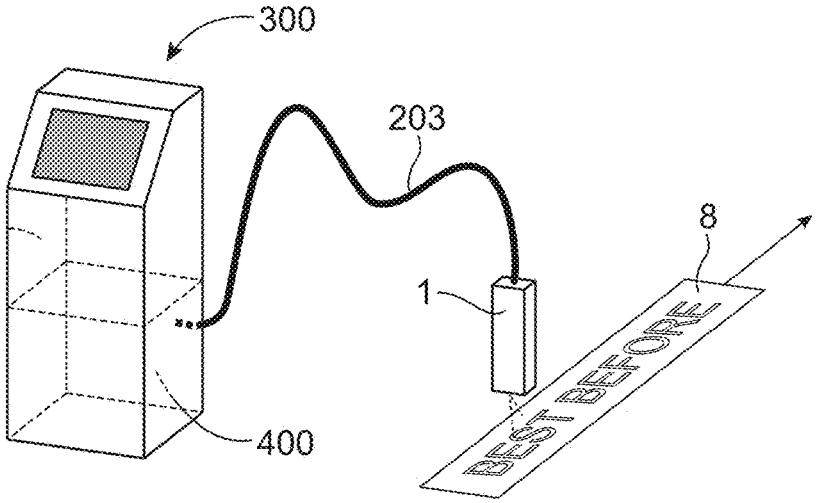
FIG. 15 shows a structure of an ink jet printer to which this invention can be applied.

FIG. 15 shows the main blocks of an ink jet printer that implements one or several embodiments described hereinabove. The printer comprises a console 300, a compartment 400 containing in particular the circuits for putting into condition the ink and solvents, as well as reservoirs for the ink and the solvents (in particular, the reservoir to which the ink recovered by the gutter is conveyed). Generally the compartment 400 is in the lower portion of the console. The upper portion of the console comprises the control electronics as well as means for viewing. The console is hydraulically and electrically connected to a print head 100 by an umbilical cord 203.

A door not shown makes it possible to install the print head facing a printing support 8, which is displaced according to a direction materialised by an arrow. This direction can be perpendicular to an axis of alignment of the nozzles. For certain applications, the angle between the direction of the displacement of the printing support and the direction of alignment of the nozzles can differ from 90°, it can be for example between 10° and 90°, in order to increase the resolution obtained.

The drop generator comprises nozzles and a cavity of the type according to one of the embodiments described hereinabove.

The invention is particularly interesting in applications where the flow rate of air or of gas, in the cavity, is substantial, because a substantial flow rate of air generates a risk that is all the more so high of allowing solvent to escape.

For example, the flow rate can be about several hundred l/h, for example between 50 l/h or 100 l/h and 500 l/h, for example about 300 l/h. These values are applied in particular in the case of a nozzle plate of 64 nozzles, but the invention also applies in the case of a nozzle plate with a lower number of nozzles, for example 32, or in the case of a nozzle plate with a higher number of nozzles, for example 128. The speed of the jets can be between 5 m/s and 20 m/s, for example it is about 15 m/s.

Figure 16:
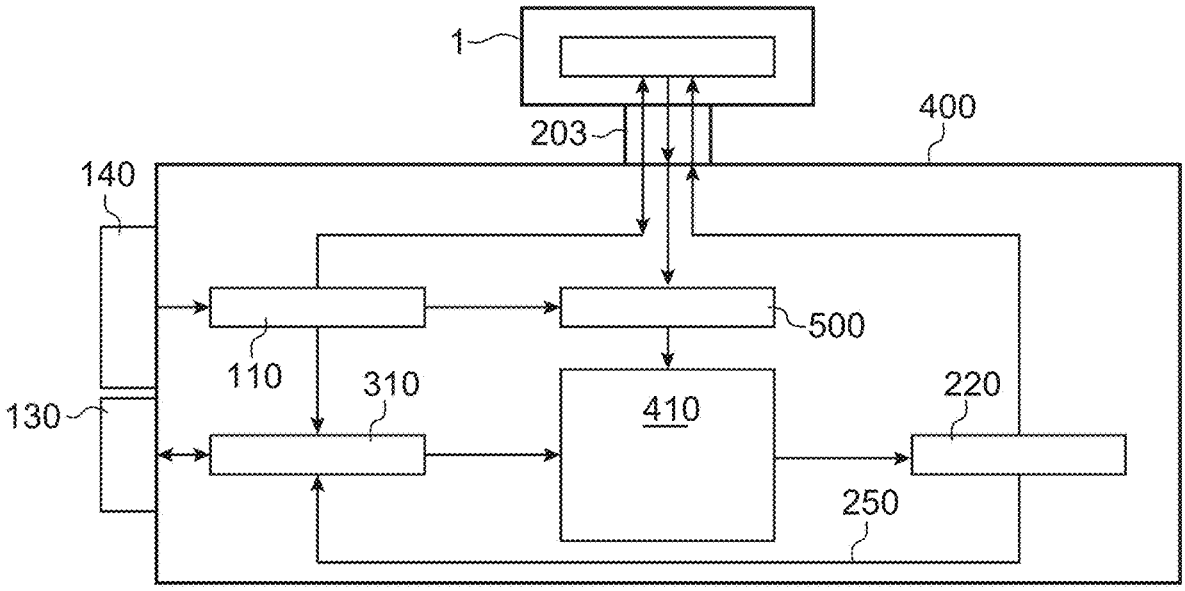
FIG. 16 shows the main blocks of an ink jet printer.

An example of fluidic circuit 400 of a printer to which the invention can be applied is shown in FIG. 16. This fluidic circuit 400 comprises a plurality of means 410, 500, 110, 220, 310, with each one associated with a specific functionality. There is also the head 1 and the umbilical cord 203.

To this circuit 400 are associated a removable ink cartridge 130 and a cartridge 140 of solvent, also removable.

The reference 410 designates the main reservoir, which makes it possible to receive a mixture of solvent and of ink.

The reference 110 designates the set of means that make it possible to sample, and possibly store, solvent using a cartridge 140 of solvent and to provide solvent thus sampled to other portions of the printer, whether it entails supplying the main reservoir 410 with solvent, or cleaning or maintaining one or several of the other portions of the machine.

The reference 310 designates the set of means that make it possible to sample ink from an ink cartridge 130 and to provide the ink thus sampled to supply the main reservoir 410. As can be seen in this figure, according to the embodiment shown here, the sending, to the main reservoir 410 and using the means 110, of solvent, passes through these same means 310.

At the outlet of the reservoir 410, a set of means, globally designated by the reference 220, makes it possible to pressurise the ink sampled from the main reservoir, and to send it towards the print head 1. According to an embodiment, shown here by the arrow 250, it is also possible, by the means 220, to send the ink towards the means 310, then again towards the reservoir 410, which allows for a recirculation of the ink inside the circuit. This circuit 220 also makes it possible to drain the reservoir in the cartridge 130 as well as to clean the connections of the cartridge 130.

The system shown in this figure also comprises means 500 for recovering fluids (ink and/or solvent) that comes back from the print head, more exactly from the gutter 7 of the print head or from the rinsing circuit of the head. These means 500 are therefore arranged downstream of the umbilical cord 203 (in relation to the flow direction of the fluids that come back from the print head).

As can be seen in FIG. 15, the means 110 can also make it possible to send solvent directly towards these means 500, without passing through the umbilical cord 203 or through the print head 1 or through the gutter for recovering.

The means 110 can comprise at least 3 parallel supplies with solvent, one towards the head 1, the $2^{nd}$ towards the means 500 and the $3^{rd}$ towards the means 310.

Each one of the means described hereinabove is provided with means, such as valves, preferably solenoid valves, that make it possible to orient the fluid concerned towards the chosen destination. Thus, using the means 110, it is possible to send solvent exclusively towards the head 1, or towards the means 500 or towards the means 310.

Each one of the means 500, 110, 210, 310 described hereinabove can be provided with a pump that makes it possible to treat the fluid concerned (respectively: $1^{st}$ pump, $2^{nd}$ pump, $3^{rd}$ pump, $4^{th}$ pump). These various pumps provide different functions (those of their respective means) and are therefore different from one another, although these different pumps can be of the same type or of similar types (in other words: none of these pumps provides 2 of these functions).

In particular, the means 500 comprise a pump ($1^{st}$ pump) that makes it possible to pump the fluid, recovered, as explained hereinabove, from the print head, and to send it to the main reservoir 410. This pump is dedicated to the recovery of fluid coming from the print head and is physically different from the $4^{th}$ pump of the means 310 dedicated to the transfer of ink or of the $3^{rd}$ pump of the means 210 dedicated to the pressurising of the ink at the outlet of the reservoir 410.

The means 110 comprise a pump (the $2^{nd}$ pump) that makes it possible to pump solvent and to send it towards the means 500 and/or the means 310 and/or towards the print head 1.

Such a circuit 400 is controlled by the means for controlling described hereinabove, these means are generally contained in the console 300 (FIG. 15).

The invention claimed is:

1. A print head of a continuous ink jet printer, comprising:

a cavity for the circulation of at least one ink jet, delimited laterally by a first side wall and a second side wall, both at least partially parallel to a direction of flow of the at least one ink jet in the cavity;

at least one nozzle for producing the at least one ink jet in said cavity;

at least one electrode for sorting drops or segments of the at least one ink jet intended for printing from drops or segments of the at least one ink jet that are not intended for printing;

an outlet slot that is open onto an exterior of the cavity, the outlet slot being configured to permit the drops or segments of the at least one ink jet intended for printing to exit the cavity;

a first gutter for recovering the drops or segments of the at least one ink jet that are not intended for printing;

at least one spraying nozzle, arranged in said cavity, for projecting at least one cleaning fluid towards at least one inner portion of the cavity and an actuator driving said at least one spraying nozzle in rotation about a first axis, perpendicular to the direction of flow of the at least one ink jet in the cavity; and a supply circuit supplying at least said at least one spraying nozzle with said at least one cleaning fluid.

2. The print head according to claim 1, the at least one spraying nozzle being arranged in the second side wall of the cavity.

3. The print head according to claim 1, the at least one spraying nozzle being configured to project the at least one cleaning fluid towards at least one of the first side wall, the at least one nozzle, the first gutter, or the at least one electrode.

4. The print head according to claim 1, said actuator being configured to drive the at least one spraying nozzle in rotation in order to project the at least one cleaning fluid into the cavity at least towards the at least one nozzle and, after or before rotation, at least towards the first gutter.

5. The print head according to claim 1, further comprising at least one orifice configured to evacuate at least a portion of the at least one cleaning fluid injected into the cavity.

6. The print head according to claim 5, the at least one orifice being formed in the first side wall or the second side wall.

7. The print head according to claim 1, the at least one spraying nozzle being configured to project the at least one cleaning fluid in the form of a jet that diverges along a second axis that is parallel to the direction of flow of the at least one ink jet or along a third axis that is parallel to the first axis.

8. The print head according to claim 7, the at least one spraying nozzle being configured to project the at least one cleaning fluid in a direction that diverges with an angle between 1° and 20° along the second axis or in a direction which diverges with an angle between 20° and 180° along the third axis.

9. The print head according to claim 1, further comprising at least one charging electrode, wherein said at least one spraying nozzle is configured to project the at least one cleaning fluid towards said at least one charging electrode.

10. The print head according to claim 1, further comprising a plate or a second gutter for closing off the outlet slot.

11. The print head according to claim 1, further comprising a second gutter, movable with respect to the first gutter, between an open position and a closed position, in which an inlet of said second gutter is arranged facing the outlet slot.

12. The print head according to claim 1, further comprising an accelerometer.

13. A continuous ink jet printer comprising:

the print head according to claim 1;

at least one circuit for supplying the print head with ink and with solvent; and a controller controlling the print head.

14. A continuous ink jet printer comprising:

the print head according to claim 1;

a controller controlling the actuator; and at least one circuit for supplying the print head with ink and with solvent, said controller controlling said at least one circuit for supplying the print head with said ink and with said solvent.

* * * * *